US011534653B2

(12) United States Patent
Constantz et al.

(10) Patent No.: US 11,534,653 B2
(45) Date of Patent: Dec. 27, 2022

(54) COLLAPSIBLE YOGA BLOCK

(71) Applicant: Lindsey Constantz, Bainbridge Island, WA (US)

(72) Inventors: Lindsey Constantz, Bainbridge Island, WA (US); Daniel S. Growald, Bainbridge Island, WA (US); James Ballard Smith, Bainbridge Island, WA (US)

( * ) Notice: Subject to any disclaimer, the term of this patent is extended or adjusted under 35 U.S.C. 154(b) by 21 days.

(21) Appl. No.: 17/040,481

(22) PCT Filed: Aug. 7, 2020

(86) PCT No.: PCT/US2020/045453

§ 371 (c)(1),
(2) Date: Sep. 22, 2020

(87) PCT Pub. No.: WO2021/030203

PCT Pub. Date: Feb. 18, 2021

(65) Prior Publication Data

US 2021/0086021 A1 Mar. 25, 2021

Related U.S. Application Data

(60) Provisional application No. 62/885,052, filed on Aug. 9, 2019.

(51) Int. Cl.
*A63B 21/00* (2006.01)

(52) U.S. Cl.
CPC ..... *A63B 21/4037* (2015.10)

(58) Field of Classification Search
CPC ..... A63B 21/00047; A63B 21/0005; A63B 21/00054; A63B 21/00105; A63B 21/002;
(Continued)

(56) References Cited

U.S. PATENT DOCUMENTS 844,955 A 2/1907 Morgan
1,198,524 A * 9/1916 Cunliffe ..... B65D 7/26 220/6

(Continued)

FOREIGN PATENT DOCUMENTS

CN 103736258 B 2/2016
CN 208453418 U 2/2019

(Continued)

OTHER PUBLICATIONS

International Search Report and Written Opinion dated Oct. 20, 2020 for corresponding PCT Application No. PCT/US2020/045453; 17 pages.

*Primary Examiner* — Nyca T Nguyen
*Assistant Examiner* — Zachary T Moore
(74) *Attorney, Agent, or Firm* — Lowe Graham Jones PLLC

(57) ABSTRACT

A yoga block includes panels forming a quadrilateral tube and secured to one another by hinges such that the tube may be collapsed. Endcaps secure to ends of the quadrilateral tube and engage the quadrilateral tube to resist collapse when in place. Panels may define protrusions engaging recesses on edges of the endcaps. Magnets in the endcaps may engage the hinges to secure the endcaps in place. Rotating or sliding tabs may also be used to lock the endcaps. Inner surfaces of top and bottom panels may define grooves for receiving a weight plate. Endcaps may be secured to panels by hinges. The hinges securing panels or endcaps may be double hinges.

14 Claims, 29 Drawing Sheets

(58) Field of Classification Search

CPC ..... A63B 21/4037; A63B 2210/06; A63B 2210/50; A63B 2209/02; A63B 2209/08; A63B 6/00; A63B 71/0036; A63B 2210/68; B65D 71/06; B65D 71/12; B65D 71/38; B65D 5/00; B65D 5/009; B65D 11/00; B65D 11/18; B65D 11/1806; B65D 11/1813; B65D 11/182; B65D 11/1826; B65D 11/1833; B65D 11/184; B65D 11/1846; B65D 11/1853; B65D 11/186; A45C 2003/007; A47C 4/00; A47C 4/04; A47C 4/045; A47C 4/52; A01K 1/0245

See application file for complete search history.

(56) References Cited

U.S. PATENT DOCUMENTS 2,320,006 A * 5/1943 Moore ..... B65D 5/00 229/120.09
3,195,506 A * 7/1965 Beard ..... B65D 7/26 217/15
3,796,342 A * 3/1974 Sanders ..... B65D 11/1826 220/6
4,693,387 A * 9/1987 Stonier ..... B42F 15/0094 220/6
4,798,304 A * 1/1989 Rader ..... B65D 11/1826 220/6
4,985,952 A 1/1991 Edelson
5,016,570 A * 5/1991 Henson ..... A01K 31/08 119/497
5,474,509 A 12/1995 Hodgdon
5,626,098 A * 5/1997 Askins ..... A01K 1/033 119/474
5,669,331 A * 9/1997 Richmond ..... A01K 1/0245 119/497
5,772,110 A * 6/1998 Garretson ..... B65D 5/009 229/120.08
5,791,292 A * 8/1998 Jempolsky ..... A01K 1/0245 119/482
5,950,260 A 9/1999 Dees
6,092,488 A * 7/2000 Allawas ..... A01K 1/0245 119/497
6,174,026 B1 * 1/2001 Wise ..... A47B 85/00 108/17
6,454,683 B1 * 9/2002 Kaye ..... A63B 71/0036 482/904
7,311,642 B2 * 12/2007 Li ..... A63B 23/0458 482/142
8,152,014 B2 * 4/2012 Elstone, Sr. ..... B65D 19/12 220/4.28
D660,068 S 5/2012 Wang
8,167,387 B1 * 5/2012 Quinn ..... A47B 43/00 312/258
8,510,878 B2 * 8/2013 Wang ..... A47G 27/0237 5/419
8,763,560 B2 * 7/2014 Chang ..... A01K 1/0254 119/500
9,095,120 B1 * 8/2015 Skaggs ..... A01K 1/0245
D762,399 S 8/2016 Sorrick et al.
10,021,990 B2 * 7/2018 Patronaggio ..... A47C 17/80
10,470,581 B2 * 11/2019 Cimadamore ..... A47C 7/14
10,617,213 B2 * 4/2020 Tang ..... A47C 4/52
10,688,371 B1 * 6/2020 Searcy ..... A45C 15/00
10,689,155 B2 * 6/2020 Sullivan ..... B65D 9/12
10,702,740 B2 * 7/2020 Tarkington ..... A63B 21/0421
10,744,361 B2 * 8/2020 Duval ..... A63B 21/4037
10,894,197 B2 * 1/2021 Searcy ..... A45C 15/00
10,960,256 B2 * 3/2021 Donnelly ..... A63B 21/4029
11,033,794 B2 * 6/2021 Tsai ..... A63B 22/0664
D936,410 S * 11/2021 Donke ..... D7/354
2004/0149600 A1 * 8/2004 Wolter ..... A45C 13/02 206/223
2007/0000447 A1 * 1/2007 Jakubowski ..... A01K 1/034 119/453
2007/0084864 A1 * 4/2007 Thrush ..... B65D 25/005 220/6
2008/0118671 A1 5/2008 Bienkiewicz
2009/0090709 A1 * 4/2009 Shalomoff ..... B65D 15/24 24/570
2010/0089336 A1 * 4/2010 Flannery ..... A01K 1/0245 119/498
2010/0258059 A1 * 10/2010 Lott ..... A01K 1/0245 119/499
2015/0053240 A1 * 2/2015 Woodlock ..... B65D 11/1846 220/4.01
2015/0111701 A1 * 4/2015 Kempka ..... A63B 5/16 482/15
2015/0175304 A1 * 6/2015 Ficker ..... B65D 11/1833 220/4.29
2015/0258363 A1 * 9/2015 Kampinski ..... A63B 21/00047 482/139
2016/0129299 A1 * 5/2016 Newman ..... A63B 21/4037 482/142
2016/0345700 A1 * 12/2016 Amago ..... A45C 7/0095
2016/0368656 A1 * 12/2016 Green ..... B65D 11/1826
2017/0080278 A1 * 3/2017 Wiggins ..... A47K 10/02
2017/0189947 A1 * 7/2017 Butler ..... A63B 21/4037
2017/0320625 A1 * 11/2017 Eckert ..... B65D 11/1873
2018/0200556 A1 7/2018 Dinkins
2018/0222625 A1 * 8/2018 Perella ..... B65D 5/4283
2018/0272180 A1 * 9/2018 Abrahams ..... A63B 21/4037
2018/0327138 A1 * 11/2018 Englert ..... B65D 11/18
2019/0270545 A1 * 9/2019 Apps ..... B65D 21/083
2019/0352050 A1 * 11/2019 Ismert ..... B65D 21/0223
2020/0282284 A1 * 9/2020 Searcy ..... A45B 27/00
2021/0086021 A1 * 3/2021 Constantz ..... A63B 21/002
2021/0329880 A1 * 10/2021 Thomas ..... A01K 1/0245

FOREIGN PATENT DOCUMENTS

GB 2501613 A 10/2013
GB 2538292 A 11/2016
TW M333199 U 6/2007
TW M394157 U 7/2010

* cited by examiner

COLLAPSIBLE YOGA BLOCK

PRIORITY CLAIM

This application claims the benefit of U.S. Provisional Application Ser. No. 62/885,052 filed Aug. 9, 2019, and entitled COLLAPSIBLE YOGA BLOCK, which is hereby incorporated herein by reference in its entirety.

FIELD OF THE INVENTION

This application relates to blocks used in practicing yoga.

BACKGROUND OF THE INVENTION

Yoga is a popular form of exercise, meditation, and spiritual practice that helps the participant develop strength and agility. Many yoga routines will make use of a block, typically made of wood, bamboo, plastic, or foam. In particular, a yoga block may be used to support the legs, hip, back, or hands of the participant to facilitate the achievement of a desired yoga pose. At times, a user may travel with their own yoga blocks. However, the blocks, while light, take up a significant amount of space.

SUMMARY OF THE INVENTION

In one aspect of the invention, a collapsible yoga block includes a quadrilateral tube having: a top panel; a bottom panel; a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge; a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another.

In some embodiments, the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel.

In some embodiments, the front cap is secured at a first edge to the first panel by the double hinge and includes a locking mechanism closer to a second edge than to the first edge, the second edge being opposite the first edge.

In some embodiments, the locking mechanism is one or more first magnetic elements and one or more second magnetic elements are secured to the first panel such that the one or more first magnetic elements engage the one or more second magnetic elements when the front cap is positioned over the outer surface of the first panel. The front cap may be secured at a first edge to the first panel by the double hinge and includes a second edge opposite the first edge. In some embodiments, one of: the second edge defines a recess sized to receive a protrusion from a second panel that is one of the top panel, the bottom panel, the right panel, and the left panel that is not the first panel; and the second edge defines a protrusion sized to insert within a recess in the second panel.

In some embodiments, the collapsible yoga block includes at least two protrusions and at least two recesses, the at least two protrusions sized to insert within the at least two recesses wherein one of: the at least two protrusions are formed in forward edges of at least two of the top panel, bottom panel, left panel, and right panel and the at least two recesses are defined by the front cap; and the at least two recesses are formed in forward edges of at least two of the top panel, bottom panel, left panel, and right panel and the at least two protrusions are defined by the front cap.

In some embodiments, the front cap has one or more magnets secured thereto and each positioned to magnetically engage with one or more of the top-left hinge, the bottom-left hinge, the top-right hinge, and the bottom-right hinge.

In some embodiments, the front cap has one or more first magnetic elements secured thereto and each positioned to magnetically engage with one or more second magnetic elements secured to a forward edge of the quadrilateral tube. The rear cap may have one or more third magnetic elements secured thereto and each positioned to magnetically engage with one or more fourth magnetic elements secured to a rearward edge of the quadrilateral tube.

In some embodiments, the front cap defines one or more indentations on an inward facing surface thereof and extending to an edge of the front cap.

In some embodiments, the front cap defines four inner openings, four magnets being mounted to an outer surface of the front cap over the four inner openings, an inner surface of the rear cap positioned opposite the outer surface facing the forward edges of the top panel, bottom panel, left panel, and right panel when the front cap is positioned over the forward end of the quadrilateral tube; and the top-left hinge, bottom-left hinge, top-right hinge, and bottom-right hinge each includes a pin protruding outwardly therefrom and magnetically engaging one of the four magnets through one of the four inner openings when the front cap is positioned over the forward end of the quadrilateral tube.

In some embodiments, each of the front cap and the rear cap includes a lock selectively engaging one of the top panel, bottom panel, left panel, and right panel.

In some embodiments, each of the top panel, bottom panel, left panel, right panel, front panel, and rear panel define a recessed portion having a pad seated within the recessed portion.

In some embodiments, each of the top panel, bottom panel, left panel, right panel, front panel, and rear panel include a ridge extending around a perimeter thereof, the recessed portion being defined by the ridge.

In some embodiments, the top-left hinge and the bottom-right hinge each include barrel portions each having a cylindrical portion and a flattened portion positioned such that upon collapsing of the quadrilateral tube, the flattened portions of the barrel portions of each of the top-left hinge and the bottom-right hinge are facing inwardly.

In some embodiments, a top groove is formed on an inner surface of the top panel facing inwardly into the quadrilateral tube and a bottom groove is formed on an inner surface of the bottom panel facing inwardly into the quadrilateral tube, the top groove and the bottom groove extending from the forward end to the rearward end of the quadrilateral tube.

In some embodiments, a plate has a top edge of the plate engaged with the top groove and a bottom edge of the plate is engaged with the bottom groove, wherein the plate is made of a first material at least 10 times as dense as a second material forming the top panel, bottom panel, left panel, and right panel.

In some embodiments, the top-left hinge is a 0-to-90 degree range-of-motion-limited hinge, the bottom-right hinge is a 0-to-90 degree range-of-motion-limited hinge, the top-right hinge is a 90-to-180 degree range-of-motion-limited hinge, and the bottom-left hinge is a 90-to-180 degree range-of-motion-limited hinge.

In another aspect of the invention, a method includes moving the front cap and the rear cap away from the quadrilateral tube; collapsing the top panel toward the bottom panel; and stowing the front cap and the rear cap against an outer surface of one of the top panel, bottom panel, left panel, and right panel.

In some embodiments, moving the front cap and the rear cap away from the quadrilateral tube comprises pivoting the front cap about a first double hinge coupling the front cap to the quadrilateral tube and pivoting the rear cap about a second double hinge coupling the rear cap to the quadrilateral tube.

In some embodiments, moving the front cap and the rear cap away from the quadrilateral tube comprises disengaging one or more first magnets in the front cap from the quadrilateral tube and disengaging one or more second magnets in the rear cap from the quadrilateral tube.

In another aspect of the invention, a collapsible yoga block includes a quadrilateral tube having: a top panel; a bottom panel; a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge. A is front cap removably positioned over a forward end of the quadrilateral tube and a rear cap removably positioned over a rearward end of the quadrilateral tube. An insert is removably positioned within the quadrilateral tube and including one or more rigid elements at a non-perpendicular angle relative to the top panel and the bottom panel.

BRIEF DESCRIPTION OF THE DRAWINGS

Preferred and alternative examples of the present invention are described in detail below with reference to the following drawings.

Figure 14A:
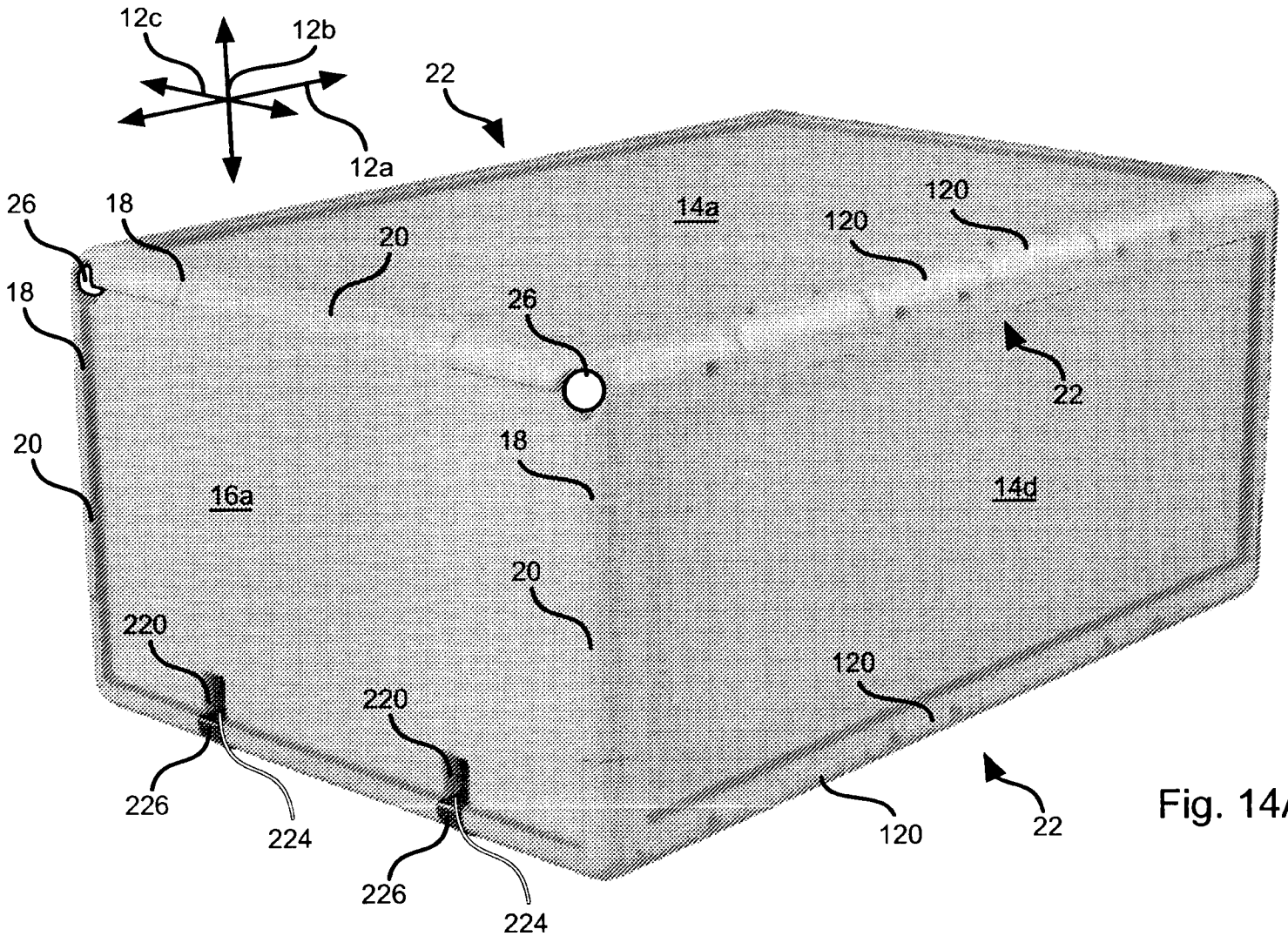
FIG. 14A is an isometric view of a yoga block with an alternative double hinge attachment of the endcaps to panels of the yoga block in accordance with an embodiment of the present invention.
Figure 14B:
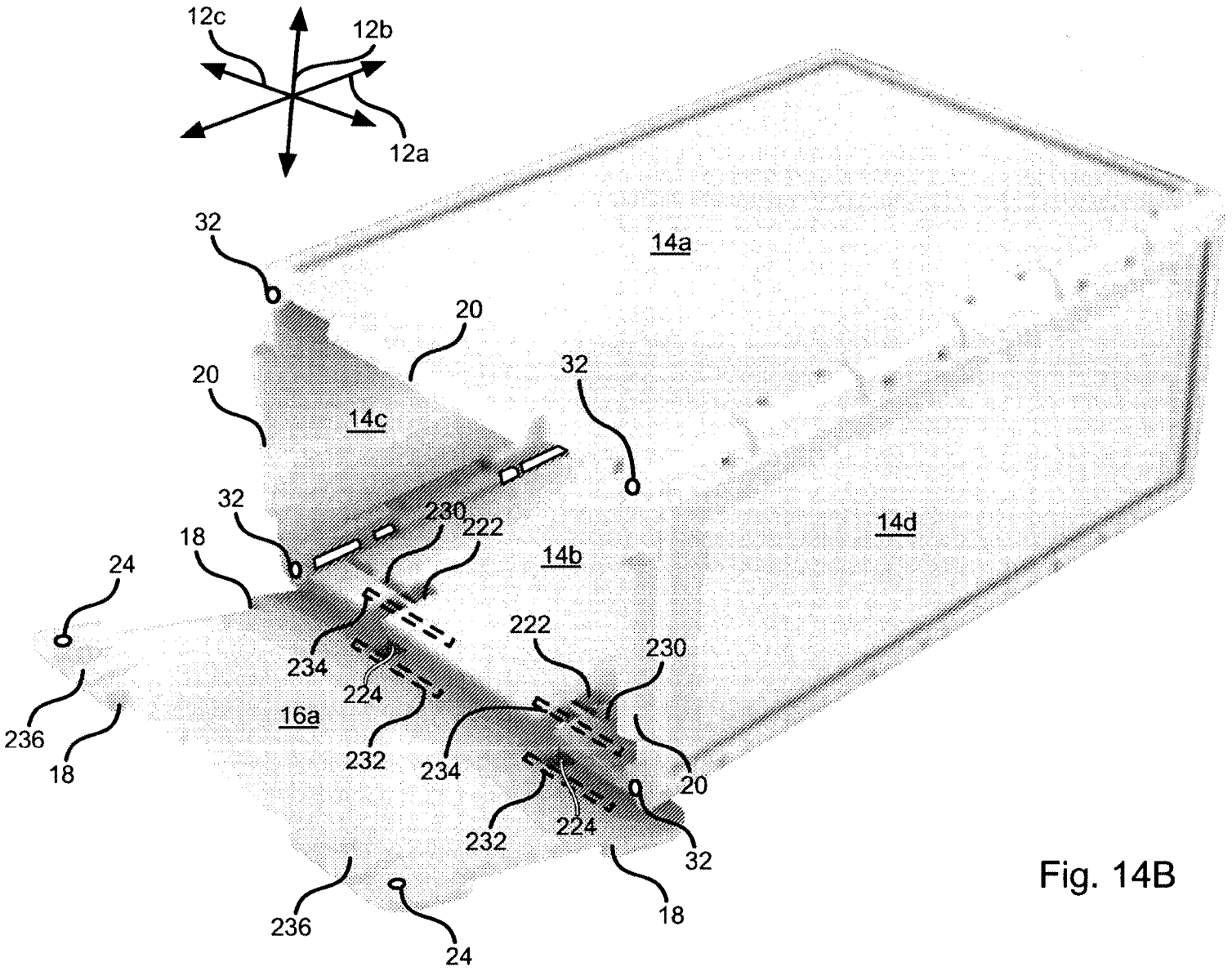
Figure 14C:
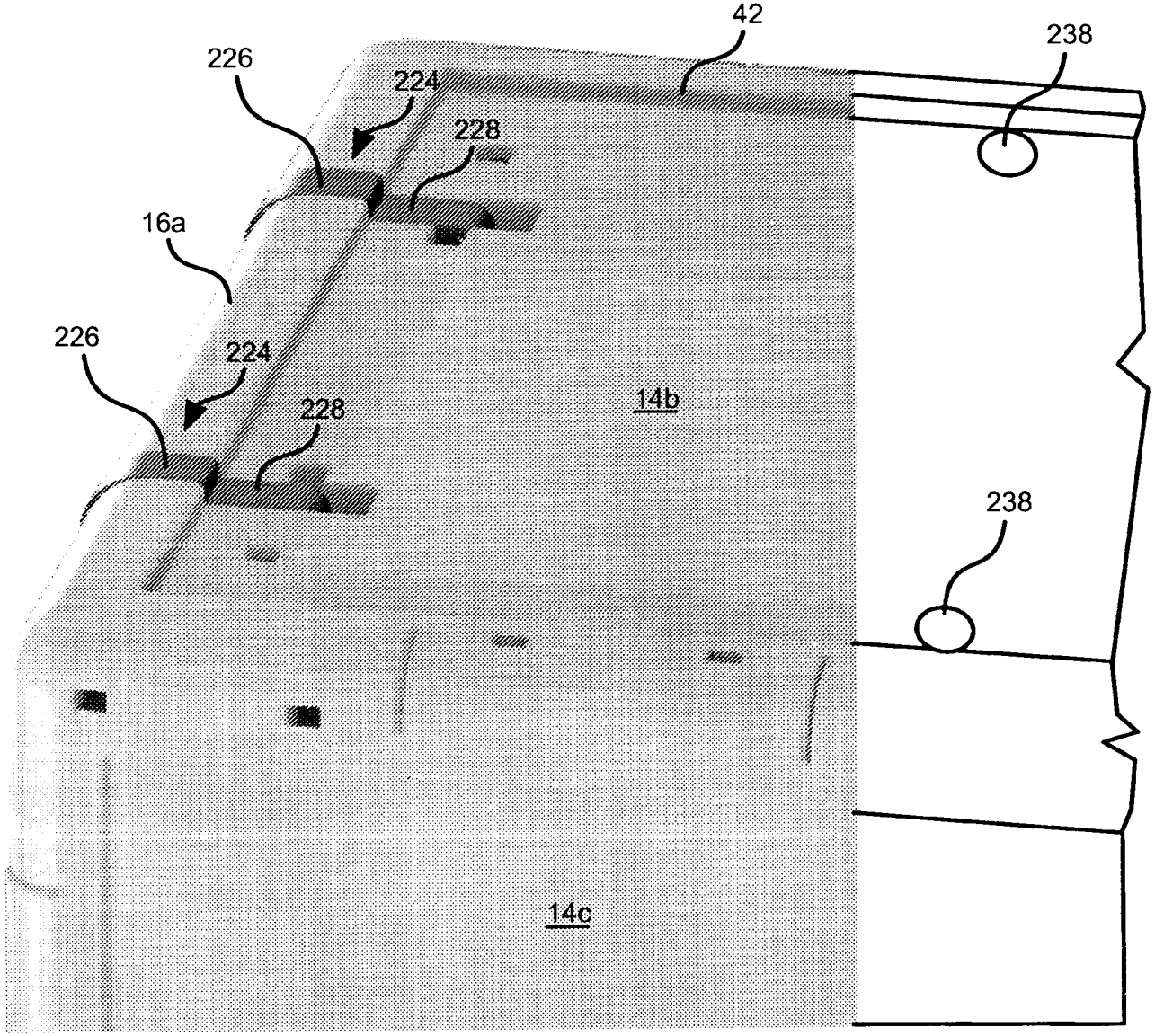

14B is an isometric view of the yoga block of FIG. 14A with an endcap pivoted away from the panels of the yoga block;

FIG. 14C is a bottom isometric view of the yoga block of FIG. 14A; and

Figure 14D:
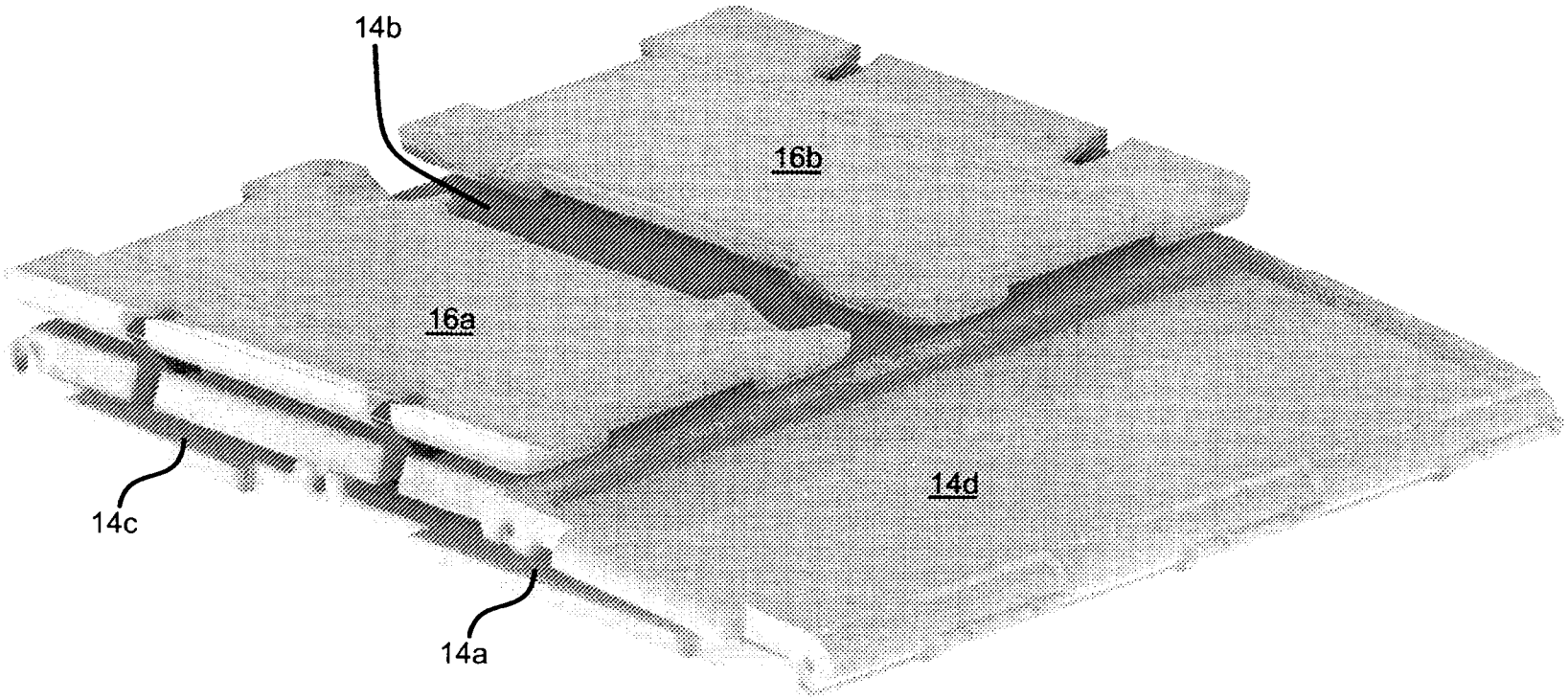

FIG. 14D is a bottom isometric view of the yoga block of FIG. 14A in a collapsed configuration in accordance with an embodiment of the present invention.

DETAILED DESCRIPTION OF THE PREFERRED EMBODIMENT

Figure 1A:
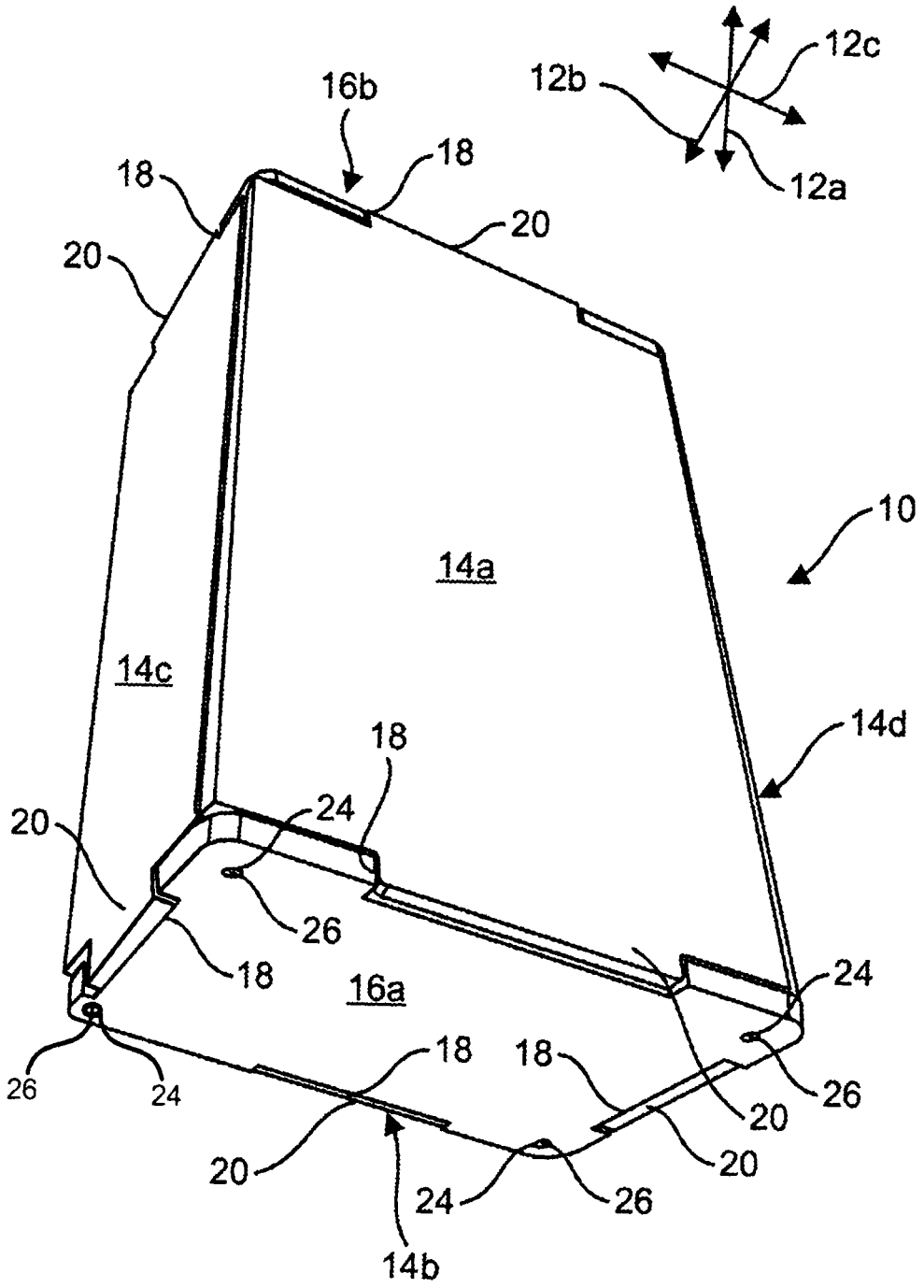
FIG. 1A is a perspective view of a yoga block in accordance with an embodiment of the present invention.
Figure 1B:
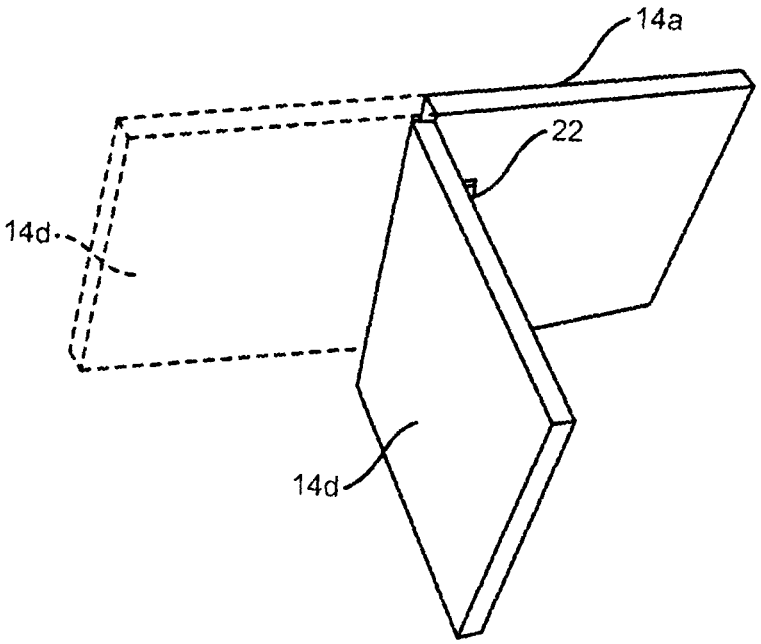
FIG. 1B is a perspective view of one approach for joining panels of a yoga block in accordance with an embodiment of the present invention.
Figure 1C:
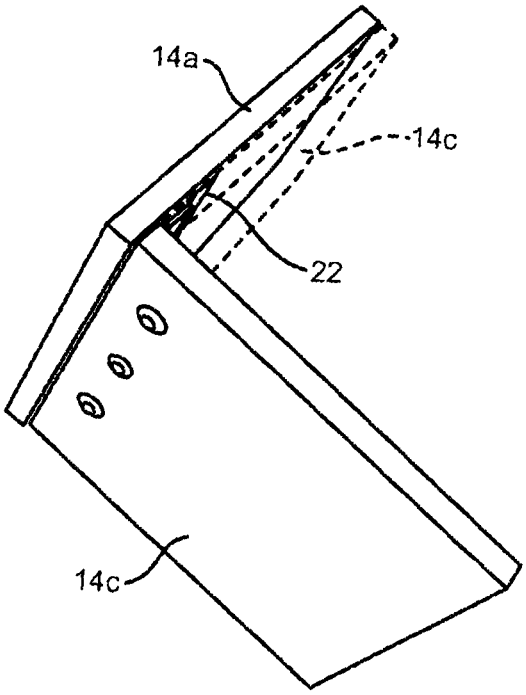
FIG. 1C is a perspective view of another approach for joining panels of a yoga block in accordance with an embodiment of the present invention.

FIGS. 1A, 1B, and 1C illustrate an example embodiment of a yoga block 10. The yoga block 10 may be understood with respect to a longitudinal direction 12*a*, vertical direction 12*b*, and transverse direction 12*c* that are all perpendicular to one another.

The yoga block 10 may include a top panel 14*a*, bottom panel 14*b*, left side panel 14*c*, and right side panel 14*d* that together define a quadrilateral tube. The terms top, bottom, left, and right panel are used for naming purposes but do not imply that the panel is actually positioned on the top, bottom, left, or right during use. In the embodiments below, features are shown on a particular panel 14*a*, 14*b*, 14*c*, 14*d* as an example embodiment with the understanding that the panels 14*a*, 14*b*, 14*c*, 14*d* are interchangeable and the features could be secured to or defined by a different panel 14*a*, 14*b*, 14*c*, 14*d* than what is shown.

The panels 14*a*, 14*b*, 14*c*, 14*d* may be made of bamboo, wood, plastic, metal, composite material (carbon fiber, fiberglass, etc.) or other material having sufficient strength to support a user (e.g., 40 to 120 kg) standing on the block 10. A left side portion of the top panel 14*a* is hingedly secured to the left side panel 14*c*. A right side portion of the top panel 14*a* is hingedly secured to the right side panel 14*d*. A left side portion of the bottom panel 14*b* is hingedly secured to the left side panel 14*c*. A right side portion of the bottom panel 14*b* is hingedly secured to the right side panel 14*d*.

FIG. 1B illustrates an example hinged attachment of the top panel 14*a* to the right side panel 14*d* by a hinge 22. As is apparent in this embodiment, the top panel 14*a* does not extend over the top edge of the right side panel 14*d*. Instead the corners of the panels 14*a*, 14*d* either touch one another or are separated by a small gap. The bottom panel 14*b* may secure to the left side panel 14*c* by means of a hinge 22 in an analogous manner with the bottom panel 14*b* not extending over the bottom edge of the left side panel 14*c*.

FIG. 1C illustrates an example hinged attachment of the top panel 14*a* to the left side panel 14*c* by a hinge 22. As is apparent in this embodiment, the top panel 14*a* extends over the top edge of the left side panel 14*c*. In a like manner, the bottom panel 14*b* may secure to the right side panel 14*d* by means of a hinge 22 in an analogous manner with the bottom panel 14*b* extending over the bottom edge of the right side panel 14*d*. There may be multiple hinges 22 joining a single pair of panels, the multiple hinges 22 being distributed along the longitudinal direction 12*a*

Figure 4:
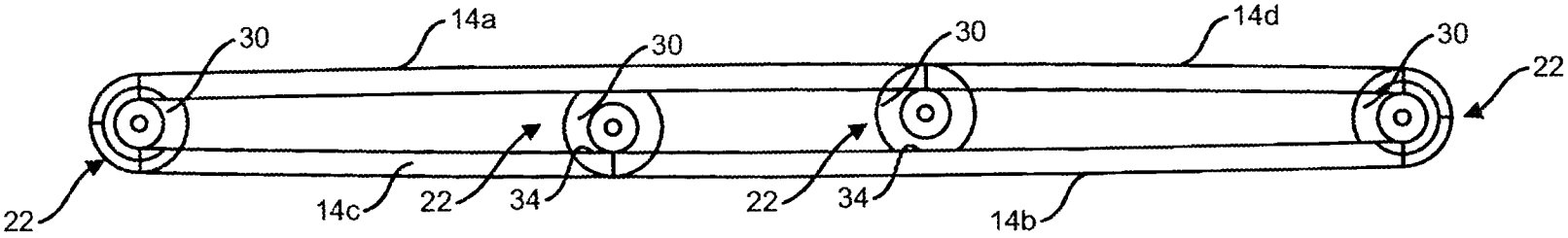
FIG. 4 is an end view illustrating operation of a hinge in accordance with an embodiment of the present invention.

The arrangement of the panels 14*a*, 14*b*, 14*c*, 14*d* shown in FIGS. 1B and 1C ensures that the top panel 14*a* may fold away from the right side panel 14*d* (see dotted representation in FIG. 1B) and that the bottom panel 14*b* may fold away from the left side panel 14*c* in the same manner. As this is done, the top panel 14*a* is allowed to pivot toward the left side panel 14*c* (see dotted representation in FIG. 1C) and the bottom panel 14*b* is allowed to pivot toward the right side panel 14*d* in the same manner. The panels 14*a*, 14*b*, 14*c*, 14*d* therefore define a collapsible quadrilateral tube. The relative orientation of the panels 14*a*, 14*b*, 14*c*, 14*d* when collapsed to a stowed position is also shown in FIG. 4.

Referring again to FIG. 1A, during use, collapse of the quadrilateral tube defined by the panels 14*a*, 14*b*, 14*c*, 14*d* may be resisted by a front end cap 16*a* and a rear end cap 16*b*. In the illustrated embodiment, each of the panels 14*a*, 14*b*, 14*c*, 14*d* defines a protrusion 20 on its forward edge and its rearward edge, the protrusions 20 extend outwardly along the longitudinal direction 12*a*. The protrusions 20 on the panels 14*a*, 14*b* occupy less than the entire width of the panels 14*a*, 14*b* in the transverse direction 12*c* (e.g., between 25 and 60 percent). Likewise, the protrusions 20 on the panels 14*c*, 14*d* occupy less than the entire height of the panels 14*c*, 14*d* in the vertical direction 12*b* (e.g., between 25 and 60 percent).

The end caps 16*a*, 16*b* define recesses 18 extending inwardly from their top, bottom, left, and right edges and sized to receive the protrusions 20. For example, as is apparent in FIG. 1A, the front end cap 16*a* receives protrusions 20 extending from the forward edges of the panels 14*a*, 14*b*, 14*c*, and 14*d*. The rear end cap 16*b* may have an identical configuration and receive identically configured protrusions 20 extending from the rearward edges of the panels 14*a*, 14*b*, 14*c*, and 14*d*.

Figure 2:
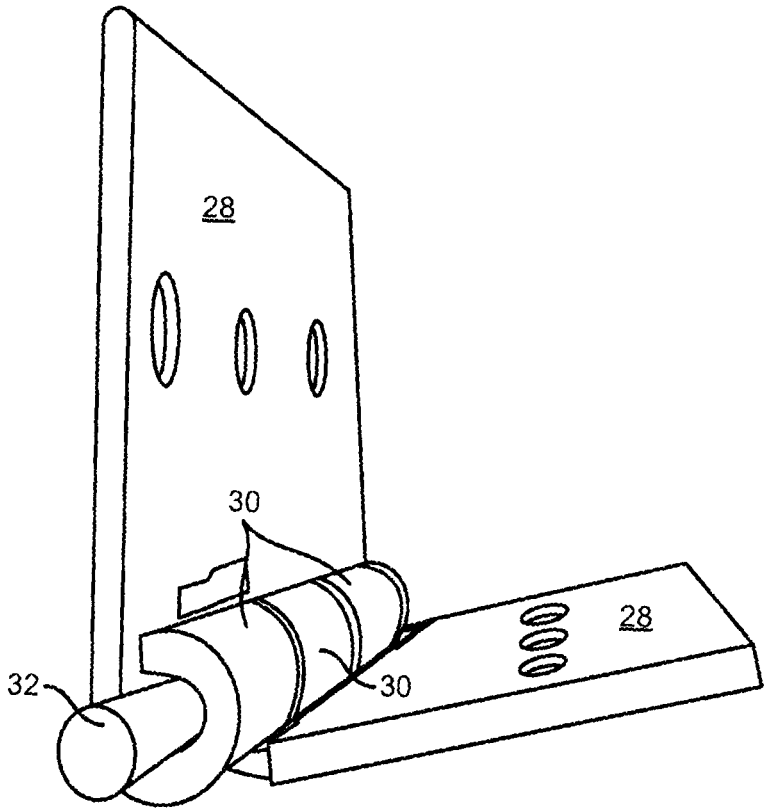
FIG. 2 is a perspective view of a hinge suitable for joining panels of a yoga block in accordance with an embodiment of the present invention.

Referring to FIG. 2 while still referring to FIG. 1A, the front and rear end caps 16*a*, 16*b* may define openings 24 having magnets 26 positioned therein. The hinges 22 may include two flanges 28 for securing to the two panels secured to one another by the hinge 22. Barrels 30 are secured to each flange 28 such that the barrels 30 of each flange 28 are interleaved with the barrels 30 of the other flange 28. A hinge pin 32 inserts through the barrels 30 to define the pivot of the hinge 22. In some embodiments, the pin 32 extends outwardly from the barrels 30 by an amount such that the pin 32 may interact magnetically with one of the magnets 26. Each magnet 26 may be positioned such that it is substantially aligned in the vertical direction 12*b* and transverse direction 12*c* with one of the pins 32 of one of the hinges 22 (e.g., within 3 mm of aligned). Likewise, each pin 32 may either contact or be within 2 mm (along the longitudinal direction 12*a*) of the magnet 26 aligned with it when the end caps 16*a*, 16*b* are engaged with the forward edges and rearward edges of the panels 14*a*, 14*b*, 14*c*, 14*d*. To that end, the pins 32 may be positioned outside of the openings 24 or extend into the openings 24 to achieve this level of proximity to the magnets 26. In some embodiments, the pins 32 are magnets such that the magnets 26 may be replaced with non-magnetized ferromagnetic material.

In some embodiments, the magnets 26 may be replaced by first magnetic elements that could be magnets or ferromagnetic material that is not magnetized. The first magnetic elements secured to an endcap 16*a*, 16*b* may be positioned engage corresponding second magnetic elements secured to any of the panels 14*a*, 14*b*, 14*c*, 14*d* at any position, e.g., at the center of the forward edge of a panel 14*a*, 14*b*, 14*c*, 14*d*. The second magnetic elements may be magnets or non-magnetized ferrous material when the first magnetic elements are magnets. The second magnetic elements may be magnets where the first magnetic elements are non-magnetized ferromagnetic material.

In some embodiments, the hinges 22 may be range-of-motion-limited hinges that only permit rotation within a certain angular range absent deformation of the hinges 22. For example, the hinges 22 may include 0-to-90 degree hinges (e.g., for joining the top panel 14*a* to the left side panel 14*c* and for joining the bottom panel 14*b* to the right side panel 14*d*) and 90-to-180 degree hinges (e.g., for joining the top panel 14*a* to the right side panel 14*d* and for joining the bottom panel 14*b* to the left side panel 14*c*). The range-of-motion-limited 0-to-90 degree hinges and 90-to-180 degree hinges may be implemented according to any approach known in the art for implementing such hinges.

Figure 3:
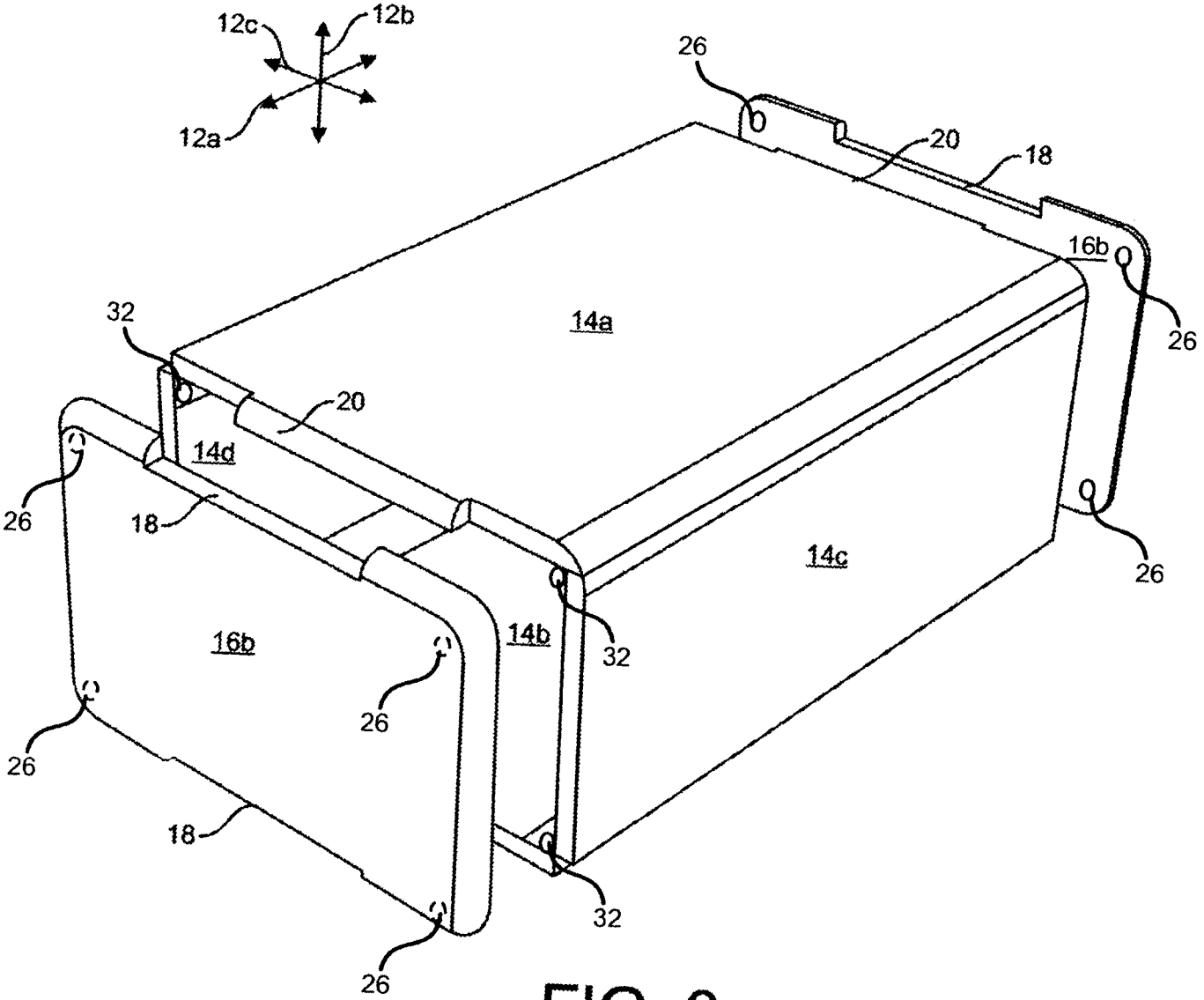
FIG. 3 is an isometric view of an alternative embodiment of a yoga block in accordance with an embodiment of the present invention.

FIG. 3 illustrates a yoga block 10 incorporating various modifications relative to the embodiment of FIG. 1A. In particular, corners of the yoga block 10 may be rounded, such as those intersections in which one panel extends over an edge of another panel (top panel 14*a* extending over top edge of the left side panel 14*c*, bottom panel 14*b* extending over bottom edge of right side panel 14*d*). As is apparent, the rounding may include rounding of the corners of both panels at the intersection to form a continuous rounded corner (see, e.g., the intersection between top panel 14*a* and right side panel 14*d*).

Another modification may include the use of only two protrusions 20 and two recesses 18. In the illustrated embodiment, the top and bottom panels 14*a*, 14*b* include protrusions 20 from their forward and rearward edges and the front and rear end caps 16*a*, 16*b* include recesses 18 extending inwardly from their top and bottom edges. In other embodiments, only the left and right side panels 14*c*, 14*c* include protrusions 20 and the front and rear end caps 16*a*, 16*b* only recesses 18 extending inwardly from their left and right edges.

In still other embodiments, any two panels 14*a*, 14*b*, 14*c*, 14*d* may include protrusions 20, whether or not positioned opposite one another, e.g. panels 14*a* and 14*c*, panels 14*a* and 14*d*, panels 14*b* and 14*c*, or panels 14*b* and 14*d*. A pair of panels 14*a*, 14*b*, 14*c*, 14*d* may define protrusions 20 on their forward edges whereas a different pair of panels 14*a*, 14*b*, 14*c*, 14*d* may define protrusions 20 on their rearward edges. In some embodiments, any three of the panels 14*a*, 14*b*, 14*c*, 14*d* define protrusions 20. The end caps 16*a*, 16*b* may define recesses 18 having a position and number configured to engage the protrusions as defined by the panels 14*a*, 14*b*, 14*c*, 14*d*.

In some embodiments, the positioning of the protrusions 20 and the recesses 18 is reversed: two or more of the panels 14*a*, 14*b*, 14*c*, 14*d* define recesses 18 extending inwardly from their forward edges in the longitudinal direction 12*a* and the front cap 16*a* defines protrusions 20 extending outwardly therefrom and positionable within the recesses 18. Likewise, two or more of the panels 14*a*, 14*b*, 14*c*, 14*d* define recesses 18 extending inwardly from their rearward edges in the longitudinal direction 12*a* and the rear cap 16*b* defines protrusions 20 extending outwardly therefrom and positionable within the recesses 18.

The embodiment of FIG. 3 may include hinges 22 as for the embodiment of FIGS. 1A to 2 and the endcaps 16*a*, 16*b* may include magnets 26 secured thereto to magnetically engage the pins 32 of these hinges 22 in the same manner.

FIG. 4 illustrates an example configuration of the panels 14*a*, 14*b*, 14*c*, 14*d* when the end caps 16*a*, 16*b* are removed and the quadrilateral tube defined by the panels 14*a*, 14*b*, 14*c*, 14*d* is collapsed. In any of the embodiments disclosed herein, the barrels 30 of the hinges 22 coupling the top panel 14*a* to the right side panel 14*d* and the barrels 30 of the hinges 22 coupling the bottom panel 14*b* to the left side panel 14*c* may include flattened portions 34. As is apparent, when the quadrilateral tube is collapsed, the flattened portion 34 of the hinge 22 coupling panels 14*b* and 14*c* interfaces with top panel 14*a*. Likewise, the flattened portion 34 of the hinge 22 coupling panels 14*a* and 14*d* interfaces with the bottom panel 14*d*. In this manner the height of the collapsed quadrilateral tube may be further reduced.

Figure 5A:
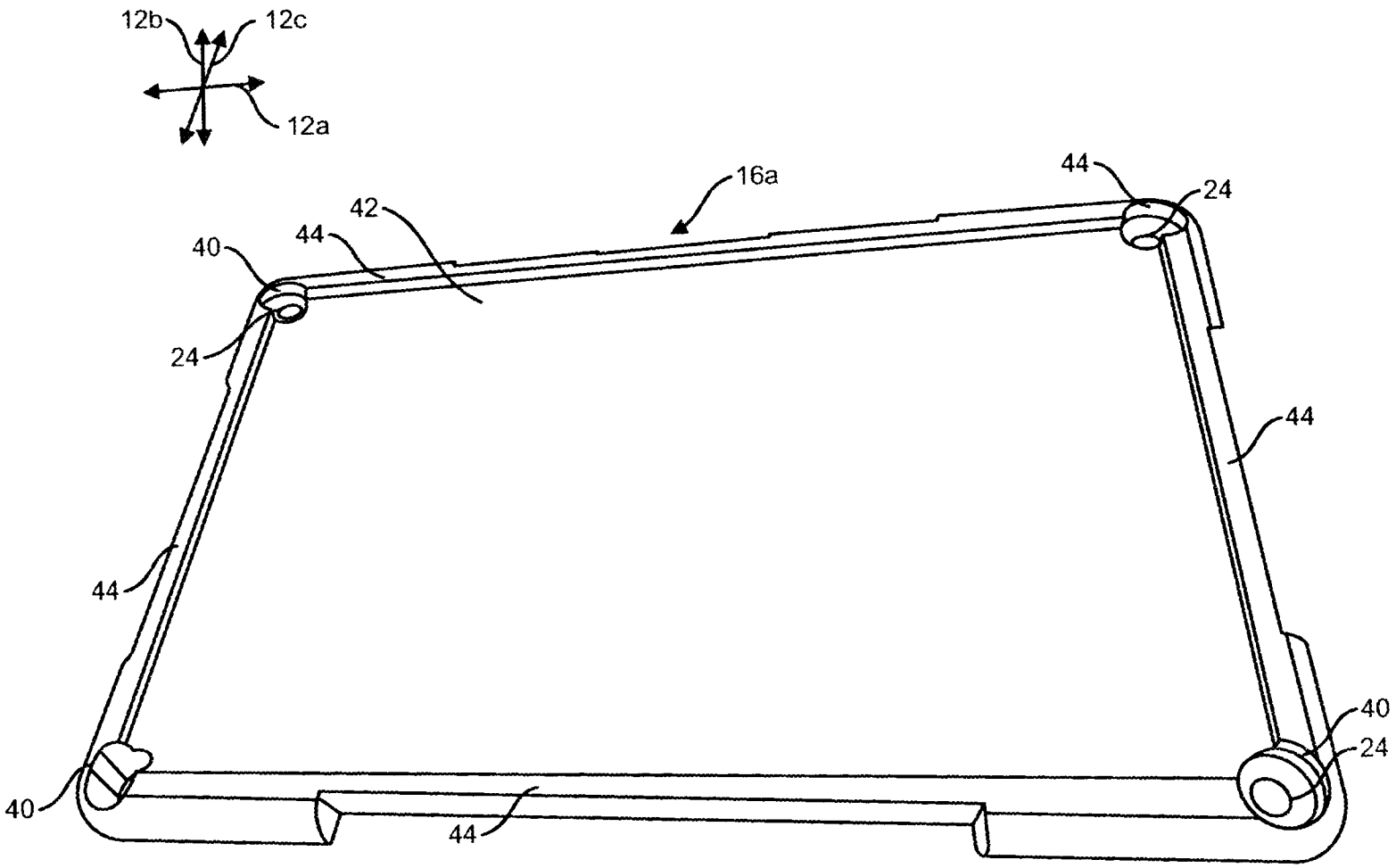
FIG. 5A is a perspective view of an endcap for a yoga block in accordance with an embodiment of the present invention.
Figure 5B:
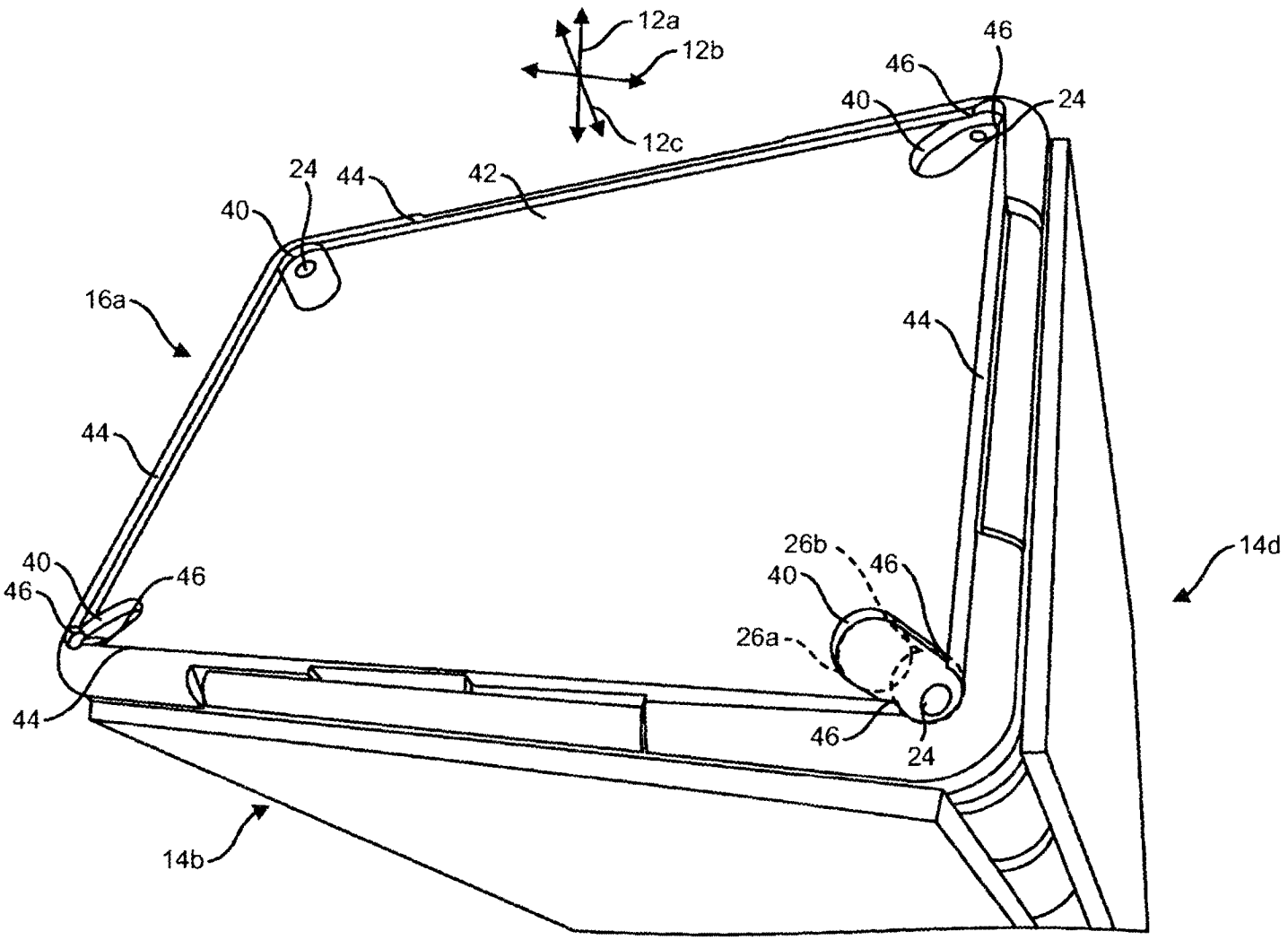
FIG. 5B is a perspective view of another embodiment of a yoga block in accordance with an embodiment of the present invention.
Figure 5C:
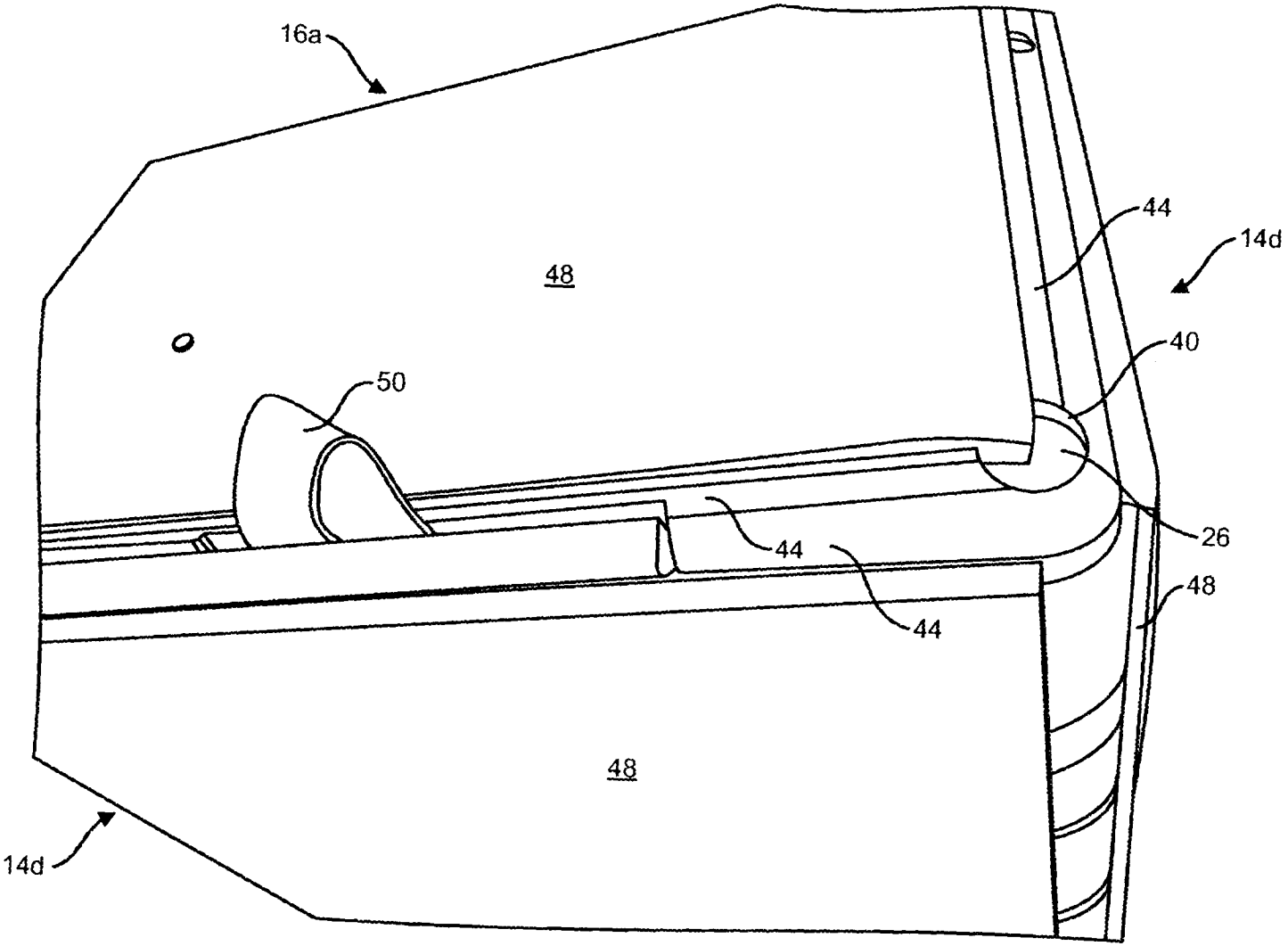
FIG. 5C is a partial perspective view of the embodiment of FIG. 5B.

FIGS. 5A, 5B, and 5C illustrate an alternative embodiments for a yoga block 10. Referring specifically to FIG. 5A, in some embodiments, an endcap 16*a*, 16*b* may include openings 40 that are concentric or overlapping with the openings 24. For example, the openings 40 may extend partially through the endcap 16*a*, 16*b* with the opening 40 being aligned with the opening 24 along the vertical direction 12*b* and the transverse direction 12*c*. The openings 24 may extend through the bottom of the opening 40. A magnet 26 may be inserted within the opening 40 and secured by means of adhesive, press fit, or some other fastening means. The magnet 26 may have a diameter greater than that of the opening 24 such that magnet 26 covers the opening 24. In use, the pin 32 of a hinge 22 may extend through the opening 24 into proximity (e.g., within 2 mm along the longitudinal direction 12*b*) to the magnet 26 in order to secure the end cap 16*a*, 16*b* to the panels 14*a*, 14*b*, 14*c*, 14*d*.

Another feature apparent in FIG. 5A is the presence of a recess 42 extending inwardly in the longitudinal direction 12*a* slightly (e.g., 2 to 10 mm) into an outward facing surface of the endcap 16*a*, 16*b*. The outward facing surface and the bottom of the recess 42 may be parallel to the vertical direction 12*b* and the transverse direction 12*c*. The recess 42 may be defined by a ridge 44 extending around the perimeter of the endcap 16*a*, 16*b*. Where openings 40 are present, the openings 40 may extend to a depth equal or below the depth of the recess 42.

Referring to FIG. 5B, in some embodiments, the openings 40 may be oblong such that the openings 40 extend around the opening 24 and also extend inwardly into the endcap 16*a*, 16*b* in a plane parallel to the vertical direction 12*b* and the transverse direction 12*c* (the "vertical-transverse plane"), such as toward the center of the endcap 16*a*, 16*b*. In use, a magnet 26 may be placed at one end of the opening 40 closest to the center of the endcap 16*a*, 16*b* (see position 26*a*). The magnet may then be slid over the opening 24 (see position 26*b*). A portion 46 of the end cap 16*a*, 16*b* may extend over the opening 40. For example, the portion 46 may be a continuation of the ridge 44 extending over the opening 40 such that the magnet 26 is positioned under that portion when at the position 26*b*. This portion 46 may be offset from the bottom of the opening 40 by an amount slightly less (e.g., 0.1 to 1 mm) than a height of the magnet 26 in the longitudinal direction 12*a* such that sliding of the magnet 26 to position 26*b* requires force and the portion 46 exerts a biasing force on the magnet 26 to resist removal of the magnet 26 from the position 26*b*.

Referring to FIG. 5C, a pad 48 may be placed in the recess 42 (see FIGS. 5A and 14C) and secured by means of adhesive or other fastening means. The pad 48 may be made of a cushioning material, such as neoprene foam, polyurethane foam, rubber, or other type of material. As is apparent in FIG. 5C, in the absence of compression, the pad 48 may protrude outwardly from the recess 42 along the longitudinal direction 12*a*, such as by from 1 to 5 mm. Alternatively, the amount of protrusion may be expressed as a percentage of the depth of the recess 42 along the longitudinal direction 12*a*, such as by between 25 and 100 percent of the depth of the recess 42. The amount of protrusion may be selected such that during typical use, e.g., for a 70 kg user standing on the block 10, the compression of the pad 48 will not result in the upper surface of the pad either exceeding or falling below the height along the longitudinal direction 12*a* of the ridge 44 (e.g. equal in height along the longitudinal direction 12*a* with the ridge 44 to within a tolerance of +/−1 mm).

Each of the panels 14*a*, 14*b*, 14*c*, 14*d* may likewise define a recess 42 having a pad 48 secured therein. The depth of the recess 42 and the thickness of the pad 48 may be within the ranges described above with respect to the recess 42 and pad 48 of the endcaps 16*a*, 16*b*. The depth of the recess 42 and thickness of the pad 48 for a panel 14*a*, 14*b*, 14*c*, 14*d* may be the same as or different from these parameters for the recess and pad 48 of either of the endcaps 16*a*, 16*b*.

FIG. 5C further illustrates a strap 50 or ribbon 50 that may be secured to each end cap 16*a*, 16*b* in order to facilitate removal of the endcap 16*a*, 16*b* from the quadrilateral tube. The strap 50 may secure to the endcap 16*a*, 16*b*, such as to an inward facing surface of the endcap 16*a*, 16*b* and positioned protruding outwardly upon securement of the endcap 16*a*, 16*b* to the quadrilateral tube. A user may then pull on the strap 50 to disengage the magnets 26 from the pins 32 of the hinges 22. The quadrilateral tube may then be collapsed as shown in FIG. 4.

Referring to FIGS. 6A, 6B, 6C, and 6D, various alternative approaches may be used to secure each endcap 16*a*, 16*b* to the quadrilateral tube. In the illustrated embodiment, an endcap 16*a*, 16*b* (16*a* in FIG. 6A) is secured by means of a notch 60 defined next to (e.g., within 1 cm of) the rearward and forward end of one of the panels 14*a*, 14*b*, 14*c*, 14*d* (forward end of panel 14*a* in FIG. 6A). The notch 60 extends inwardly into the panel 14*a* from an inward facing surface of the panel 14*a*. A tab 62 mounted to a rotatable shaft 64 may be rotated into the notch 60 and thereby resist removal of the endcap 16*a* from the forward end of the quadrilateral tube. The shaft 64 extends through the endcap 16*a* such that the tab 62 is positioned on an inner side of the endcap 16*a* and a handle 66 secures to the shaft 64 on an outer side of the endcap 16*a* opposite the inner side. The user may therefore grasp the handle 66 in order to rotate the tab 62 into and out of engagement with the notch 60.

Figure 6A:
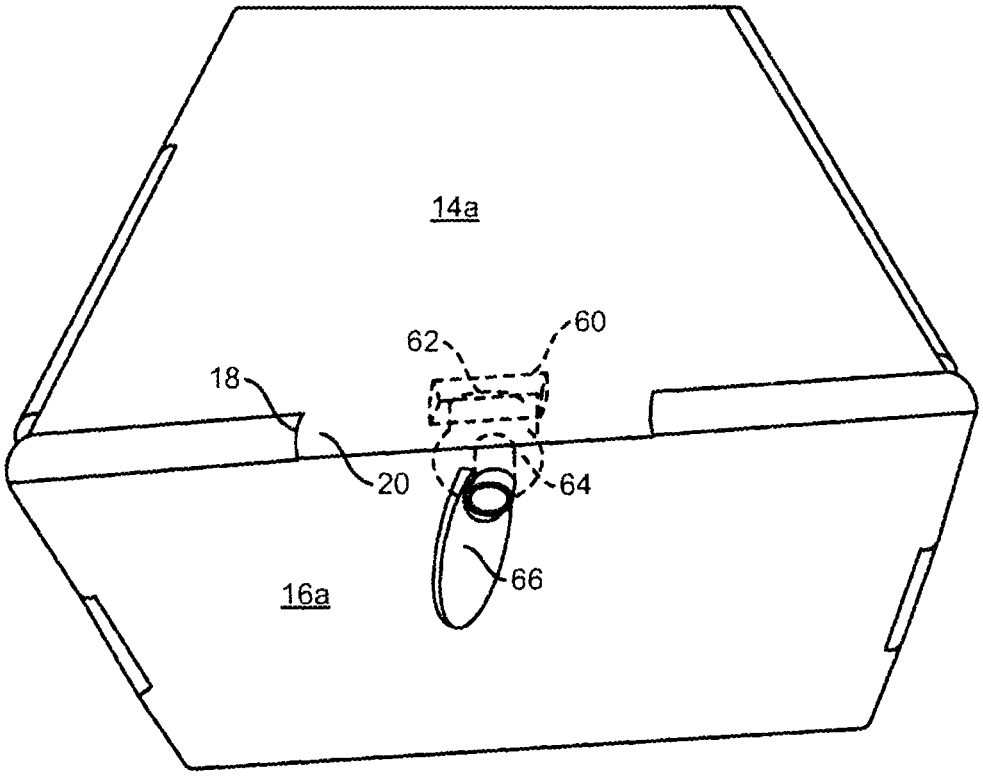
FIG. 6A through 6E illustrate a locking mechanism for a yoga block in accordance with an embodiment of the present invention.
Figure 6B:
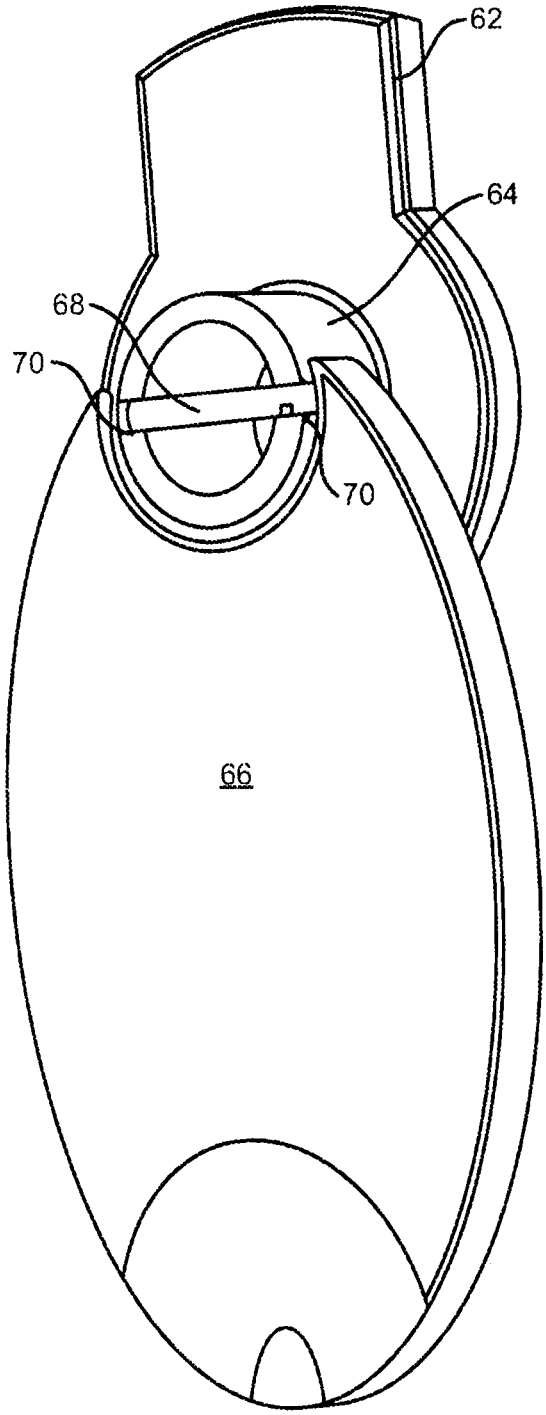
Figure 6C:
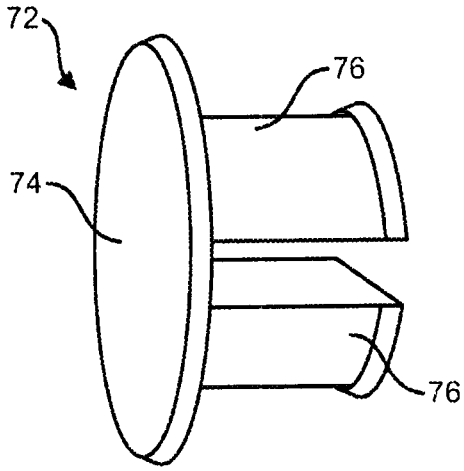
Figure 6D:
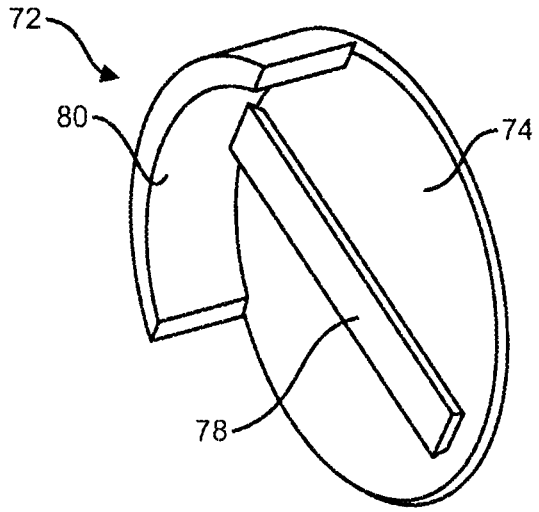

Referring specifically to FIG. 6B, the handle 66 may be rotatably secured to the shaft 64, such as by means of a pivot pin 68 passing through the shaft 64 and secured at its ends to the handle 66. The shaft 64 may define a through opening or notch 70 into through which the pin 68 passes. In the illustrated embodiment, the shaft 64 is hollow and may be covered by a cap 72, such as the cap 72 of FIG. 6C or the cap of 72 of FIG. 6D. The cap of FIG. 6C includes an end plate 74 sized to cover the end of the shaft 64 and detent tabs 76 that extend into the shaft 64 in order to retain the cap 72 within the shaft 64. The shaft of FIG. 6D includes an end plate 74 sized to cover the end of the shaft 64 and a rib 78 sized to insert within the notch 70. The rib 78 may be secured to the shaft 64 by means of an adhesive or by means of a press fit within the notch 70. In some embodiments, a cylindrical section 80 secures around a portion of the end plate 74 and extends partially around the shaft 64 when the cap 72 is secured to the shaft 64.

Figure 6E:
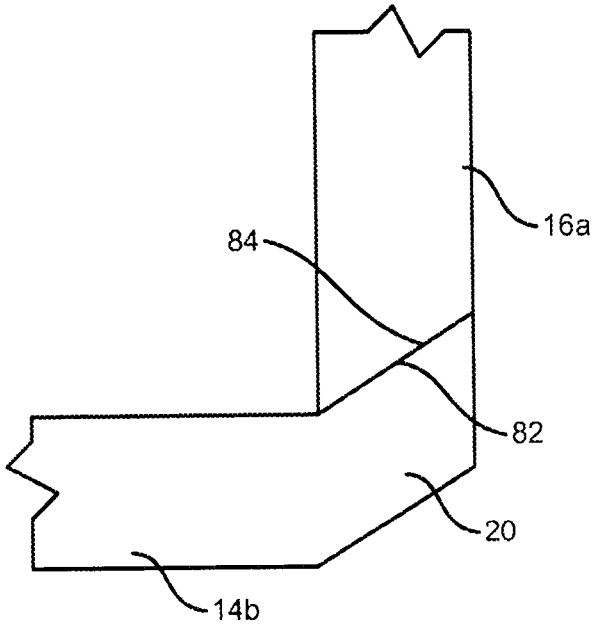

Referring to FIG. 6E, in the illustrated embodiment, the protrusion 20 of the bottom panel 14*b* may define an upwardly angled surface 82 that acts as a hook to capture the bottom edge of the front endcap 16*a*. The bottom edge of the front end cap 16*a*, e.g., a surface 84 at the bottom of the recess 18 may have a similar angle such that the surface 84 may interface with the surface 82.

Note that the relative positions of elements of the securement approach of FIGS. 6A to 6E may be rearranged. For example, the notch 60 may be formed in the left side panel 14*c* and the angled surface 82 may be secured to the right side panel 14*d*, or vice versa. Although the securement of the front endcap 16*a* to the forward end of the quadrilateral tube is shown, the rear endcap 16*b* may secure to the rearward end of the quadrilateral tube using any of the above described approaches.

Figure 7A:
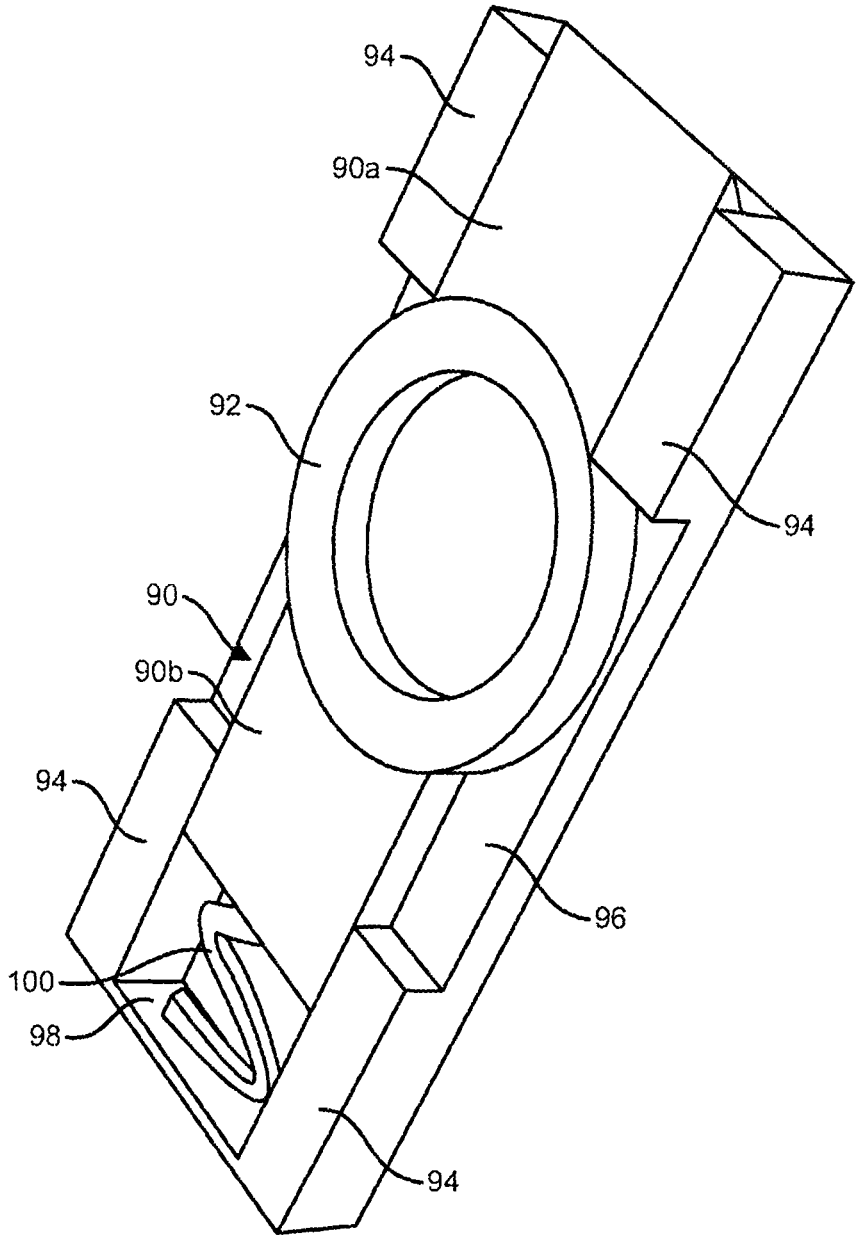
FIG. 7A through 7C illustrate an alternative locking mechanism for a yoga block in accordance with an embodiment of the present invention.
Figure 7B:
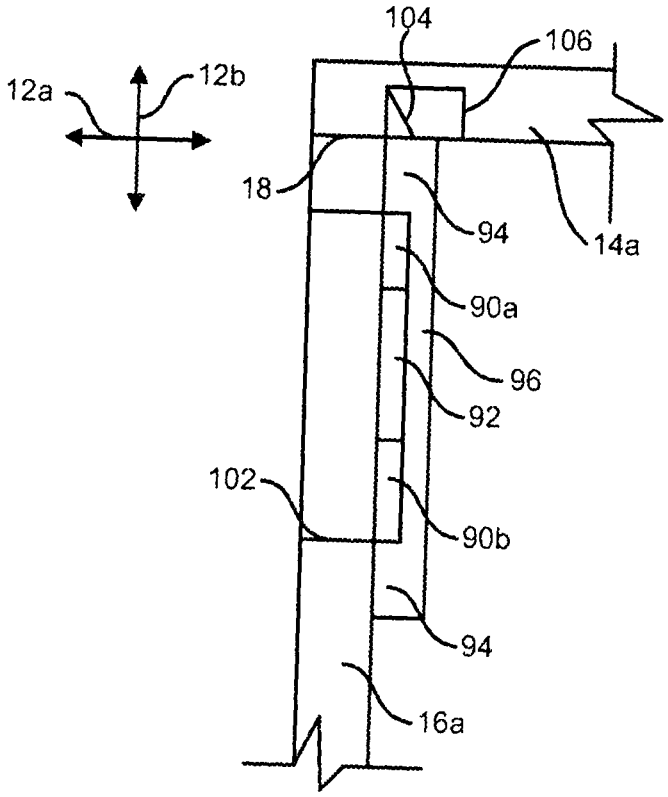
Figure 7C:
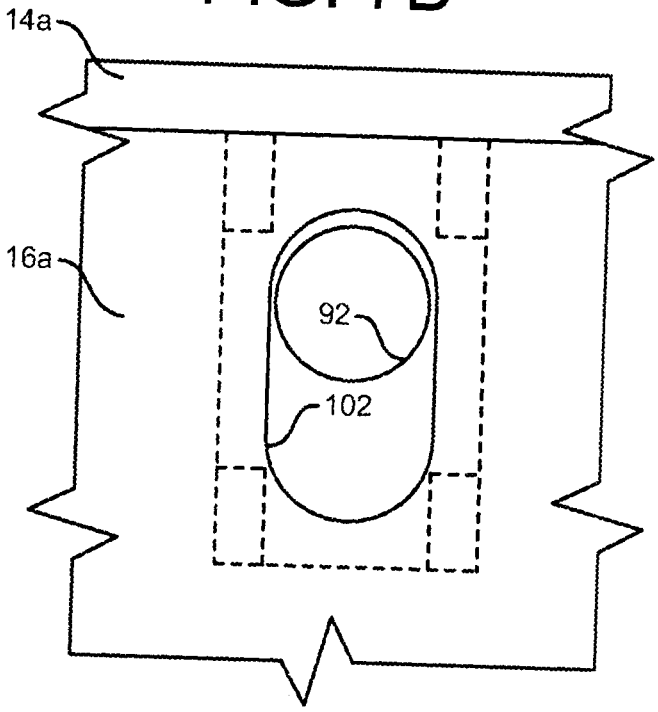

FIGS. 7A, 7B, and 7C illustrate an alternative closure mechanism for securing the endcaps 16*a*, 16*b* to the quadrilateral tube. A slider 90 includes a feature enabling a user to exert force on the slider 90. In the illustrated embodiment, this feature is a ring 92 into which a user may insert a fingertip. However, a tab extending outwardly from the slider 90 may also be used. In the illustrated embodiment, the slider 90 includes an upper portion 90*a* and a lower portion 90*b* secured on either side of the ring 92. The slider 90 slides within guides 94 secured to, or formed on, a backing plate 96. In the illustrated embodiment, the guides include a pair of guides 94 on either side of the upper portion 90*a* and a pair of guides on either side of the lower portion 90*b*. A gap between the pairs of guides 94 may provide clearance for the ring 92 to slide within a range of motion. A cross member 98 may secure to the guides 94 and/or the backing plate 96. A biasing member 100 is positioned between the slider 90 and the cross member 98. In the illustrated embodiment, the biasing member is a co-molded with the slider 90.

Referring specifically to FIGS. 7B and 7C, while still referring to FIG. 7A, in some embodiments, the guides 94 are secured to the inner surface of an endcap 16*a*, 16*b* such that the slider 90 is captured between the backing plate 96 and the inner surface of the endcap 16*a*, 16*b*. The endcap 16*a*, 16*b* defines an oblong opening 102 and the slider 90 is positioned over this opening such that the ring 92 is accessible through the opening 102 and positioned closer to a top end of the opening 102 than to the bottom end of the opening 102 when the biasing member 100 is undeformed. When the biasing member 100 is undeformed one end of the slider 90 protrudes above the backing plate 96 and above the recess 18 in the endcap 16*a*, 16*b* as shown in FIG. 7B. The protrusion 20 on the upper panel 14*a* (or other panel 14*b*, 14*c*, 14*d* depending on the configuration) may include a recess 106 on an inner surface that is positioned to receive the protruding portion of the slider 90 when the endcap 16*a*, 16*b* is engaged with an end of the quadrilateral tube.

This protruding portion of the slider 90 may include an angled face 104. The angled face 104 may allow the slider 90 to be forced inward as the angled face 104 engages the protrusion 20 and then be pushed into the recess 106 by the biasing member 100 once it is aligned with the recess 106, as shown in FIG. 7B.

To remove the endcap 16*a*, 16*b*, the user inserts a fingertip into the ring 92 and slides the ring 92 and slider 90 downward, thereby removing the protruding portion of the slider 90 from the recess 106 and allowing the endcap 16*a*, 16*b* to be removed from the end of the quadrilateral tube. Note that where the closure mechanism of FIGS. 7A to 7C is used, angled surfaces 82, 84 (see FIG. 6E) may be used to secure an edge of the endcap 16*a*, 16*b* that is opposite the edge from which the slider 90 protrudes as described above with respect to FIG. 6E.

Figure 8A:
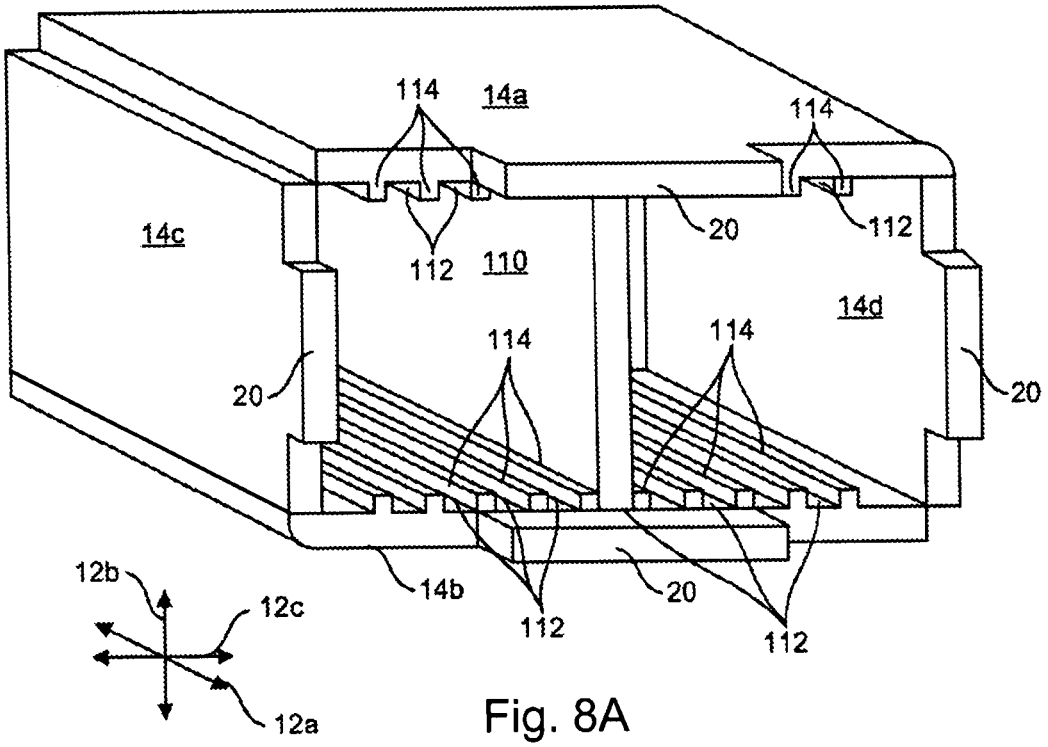
FIG. 8A is an isometric view illustrating an approach for securing weights within a yoga block in accordance with an embodiment of the present invention.

Referring to FIG. 8A, a yoga block 10 according to any of the embodiments disclosed herein may include features enabling the mounting of weight plates 110 within the yoga block 10. For example, the top panel 14*a* and the bottom panel 14*b* may define grooves 112 that are substantially (e.g., within 3 mm of) aligned with one another in the transverse direction 12*c* when the left and right side panels 14*c*, 14*d* are oriented parallel to the vertical direction 12*b*, i.e. are not in their collapsed configuration. In some embodiments, the grooves 112 may be formed in the left and right side panels 14*c*, 14*d* and be used in a like manner. A weight plate 110 may therefore be inserted with one edge in a groove 112 defined by the top panel 14*a* and a second groove 112 in the bottom panel 14*b* that is aligned with the groove in the top panel 14*a*. The grooves 112 may be defined by protrusions 114 that extend inwardly from inner surfaces of the panels 14*a*, 14*b* and also extend along the panels 14*a*, 14*b* in the longitudinal direction 12*a*.

The grooves 112 may extend between the forward and rearward edges of the panels 14*a*, 14*b*. However, the grooves 112 do not extend over the protrusions 20 of the panels 14*a*, 14*b* in some embodiments. The grooves 112 are shown distributed along substantially all (e.g., at least 80 percent) of the width of the bottom panel 14*a* in the transverse direction 12*c*. However, in other embodiments, grooves 112 are distributed along a smaller proportion of the width of the bottom panel 14*a*, e.g. between 50 and 25 percent. In such embodiments, this portion of the width including grooves is centered on the center of the width of the bottom panel 14*a* and may include at least one groove 112 that has its center along the transverse direction 12*c* substantially identical (e.g., within 3 mm) to the center of the width of the bottom panel 14*a*. In some embodiments, there is a single groove 112 centered in this manner on the top panel 14*a* and another single groove 112 centered in this manner on the bottom panel 14*b*.

The weight plates 110 are intended to add weight to the yoga block and may therefore be made of a dense material, such as wood, dense plastic, ceramic, metal (e.g., steel, aluminum, lead). The material for the plates 110 may be at least 10, or at least 100, or at least 1000 times as dense as the material forming the panels 14*a*, 14*b*, 14*c*, 14*d* and the endcaps 16*a*, 16*b*.

Multiple plates 110 may be used simultaneously subject only to the limit of the number of grooves 112. The weight plates 110 may have a width in the transverse direction such that the fit between the weight plates 110 and the grooves is snug such that force is required to insert the weight plates 110 and the weight plates 110 do not shift during use. For example, the width of the weight plate 110 relative to the widths of the grooves 112 may be such that at least a 20

Newton force is required to slide the plate 110 to its completely inserted position within the yoga block, i.e. a position in which the endcaps 16*a*, 16*b* may be secured contacting the rearward and forward edges of the quadrilateral tube.

In some embodiments, the engagement of at least one plate 110 with the grooves 112 may resist collapse of the quadrilateral tube formed by the panels 14*a*, 14*b*, 14*c*, 14*d*. Accordingly, the grooves 112 in such embodiments may be of sufficient depth to reduce rotation of the plate 110 within the grooves, e.g. between 0.5 and 2 cm.

Figure 8B:
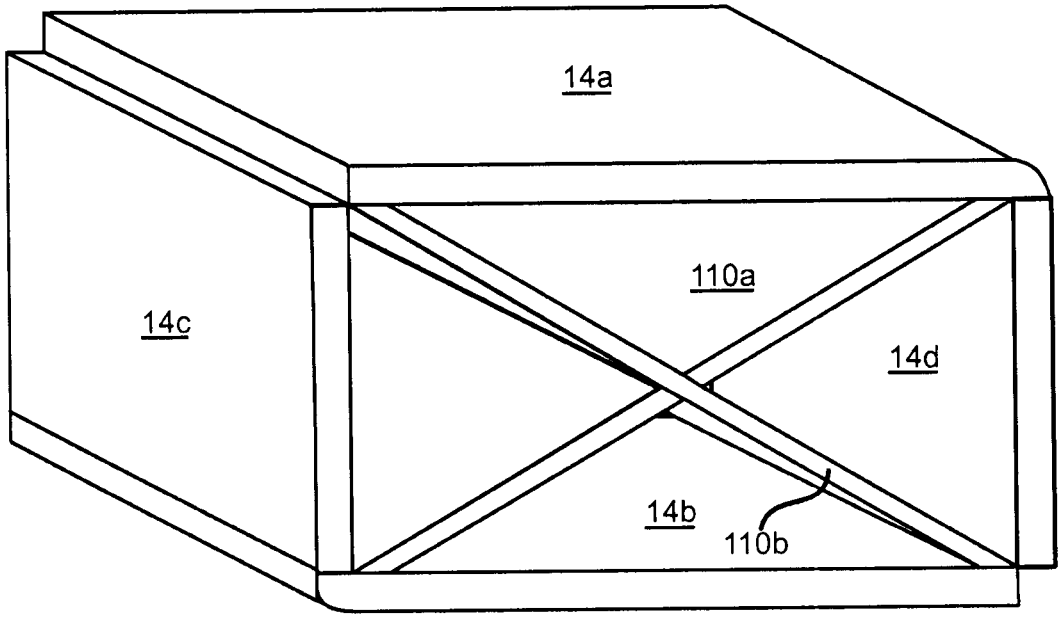
FIG. 8B is an isometric view illustrating an insert for resisting collapse in accordance with an embodiment of the present invention.

Referring to FIG. 8B, in some embodiments, one or more rigid elements, such as plates 110*a*, 110*b*, may be arranged in a non-perpendicular configuration (e.g., between 15 and 75 degrees from a plane parallel to the longitudinal direction 12*a* and the vertical direction 12*b*) in order to provide one or both of stiffening and weighting functions. For example, two notched panels may be interleaved to form an 'X' shape as shown in FIG. 8B in order to prevent collapse. Alternatively, panels may be arranged in a zig-zig or 'Z' shape and inserted to prevent collapse, e.g. a metal plate bent into a 'Z' shape or metal plates secured to one another to form a 'Z' shape. In embodiments including one or more angled plates 110*a*, 110*b*, the angled plates may engage grooves on the top and bottom panels 14*a*, 14*b*, on the left and right panels 14*c*, 14*d*, or grooves may be omitted and the plates 110*a*, 110*b* may be sized to remain in place without the use of grooves, such as in the embodiment of FIG. 8B.

Figure 9:
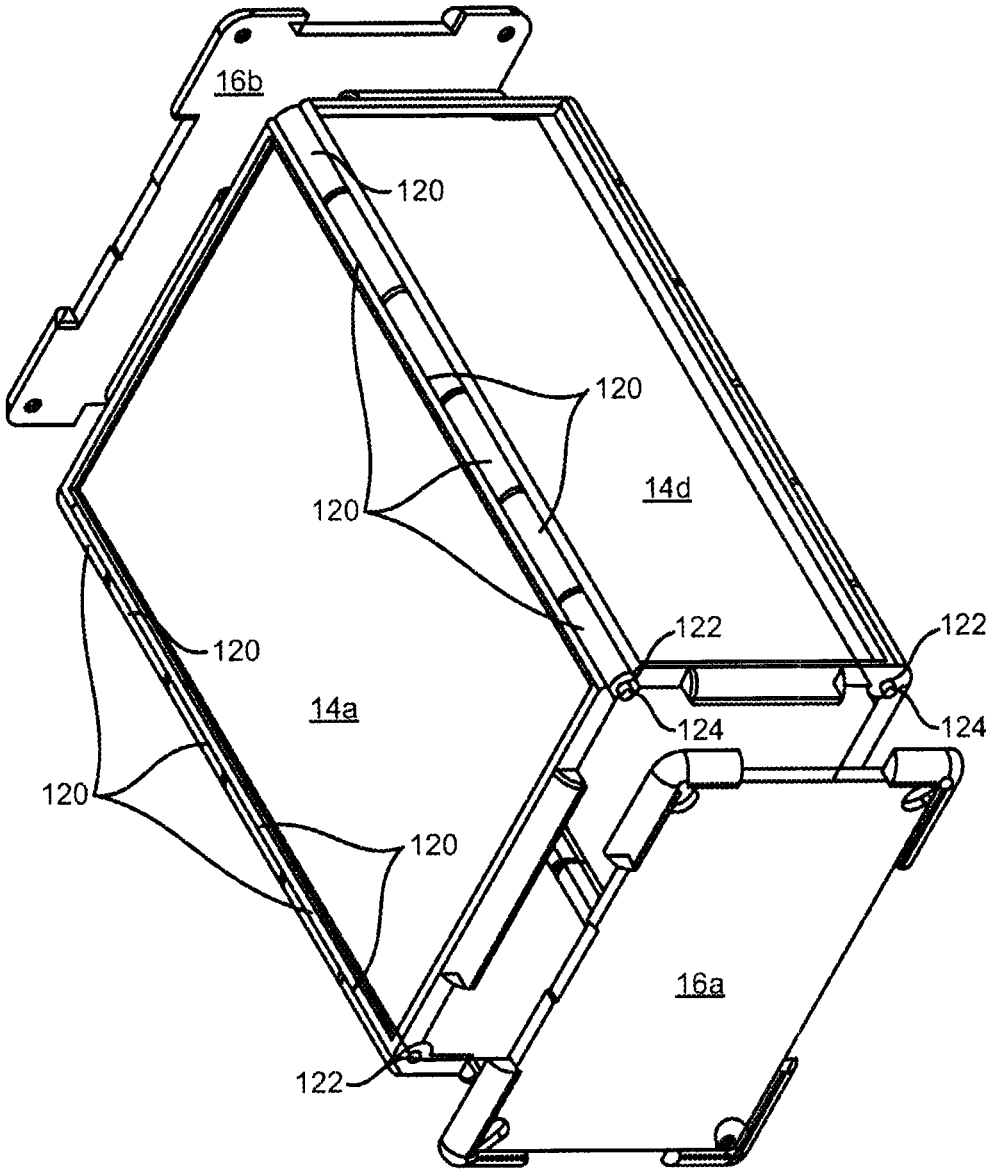
FIG. 9 is an isometric view of a yoga block having alternative hinges in accordance with an embodiment of the present invention.

Referring to FIG. 9, various alternative embodiments of a hinge 22 may be used. In the illustrated embodiment, the hinges 22 are formed integrally with the panels 14*a*, 14*b*, 14*c*, 14*d*. For example, in the illustrated embodiment, the left and right edges of the panels 14*a*, 14*b*, and the top and bottom edges of the panels 14*c*, 14*d* define a plurality of extensions 120. The extensions 120 define an opening 122 extending therethrough in the longitudinal direction 12*a*. The extensions 120 of each panel 14*a*, 14*b*, 14*c*, 14*d* interleave with the extensions 120 of adjacent panels 14*a*, 14*b*, 14*c*, 14*d* and hinge pins 124 are inserted through the openings 122 in order to define the hinge 22. The hinge pins 124 may be located to engage magnets in an endcap 16*a*, 16*b* as for other embodiments described herein. As is apparent in FIG. 9, the extensions 120 may be rounded such that the interleaved extensions 120 define a rounded corner of the yoga block 10. The interleaved extensions 120 may include range-of-motion limitations.

Figure 10:
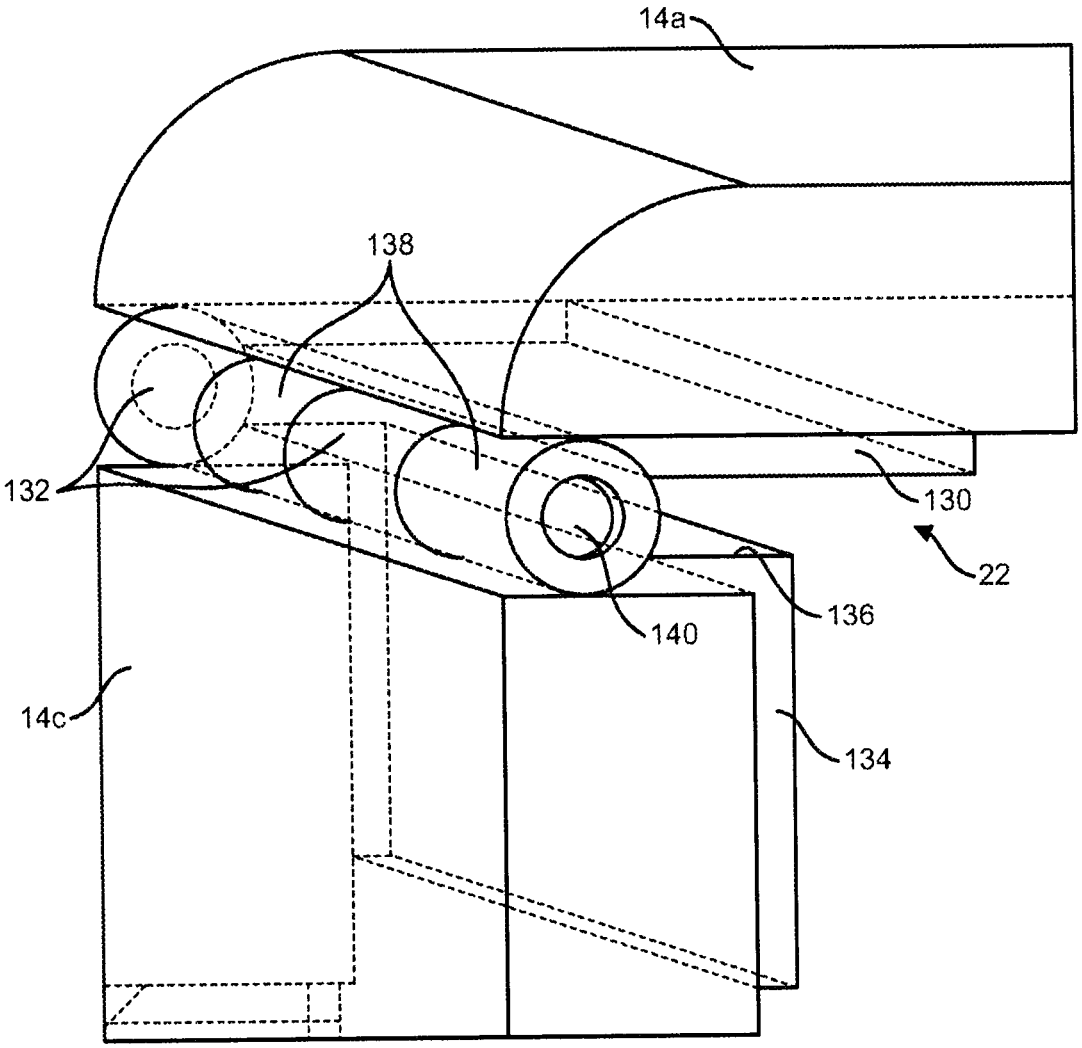
FIG. 10 is an isometric view illustrating another alternative hinge for securing adjacent panels of a yoga block in accordance with an embodiment of the present invention.

FIG. 10 illustrates another alternative embodiment for a hinge 22. The illustrated hinge 22 may be used where one panel extends over the edge of the another panel (e.g., the top panel 14*a* extending over the top edge of the left side panel 14*c* or the bottom panel 14*b* extending under the bottom edge of the right side panel 14*d* in embodiments described above). The panels 14*a*, 14*c* are considered in the illustrated example and the panels 14*b*, 14*d* may be configured in an identical manner.

The hinge 22 may include a flange 130 secured to an inner surface of the top panel 14*a* and having hinge barrels 132 secured thereto. As is apparent in the illustrated embodiment, the hinge barrels 132 are positioned between the inner surface of the top panel 14*a* and the top edge of the left side panel 14*c* in the illustrated embodiment, as opposed to being positioned inward from the left side panel 14*c* in other embodiments described above.

A flange 134 is secured to an inner surface of the left side panel 14*c*, such as by means of screws, bolts, or other securement means. The flange 134 secures, e.g. is formed monolithically with, a second flange 136 that is oriented perpendicular to the flange 134 and extends over the top edge of the left side panel 14*c*. Hinge barrels 138 may be secured to the distal end of the flange 136 opposite the edge of the flange 136 secured to the flange 134. The hinge barrels 138 interleave with the hinge barrels 132 and a hinge pin 140 is inserted through the hinge barrels 132, 138 to define the pivot of the hinge 22.

Figure 11A:
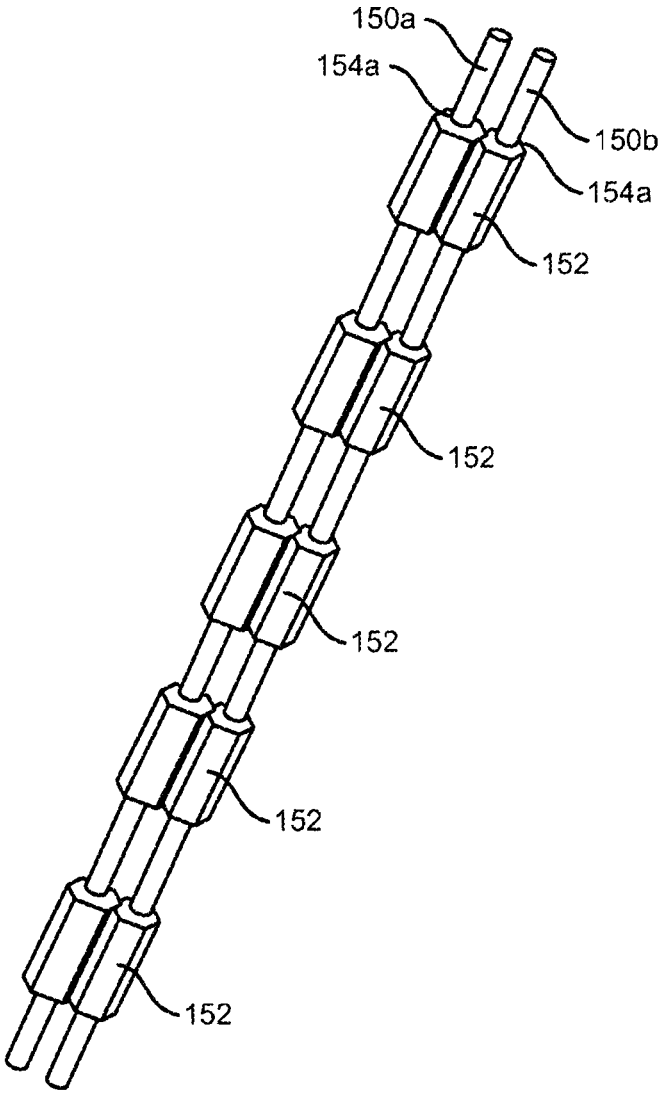
FIGS. 11A to 11D illustrate double hinges for securing adjacent panels of a yoga block in accordance with an embodiment of the present invention.
Figure 11B:
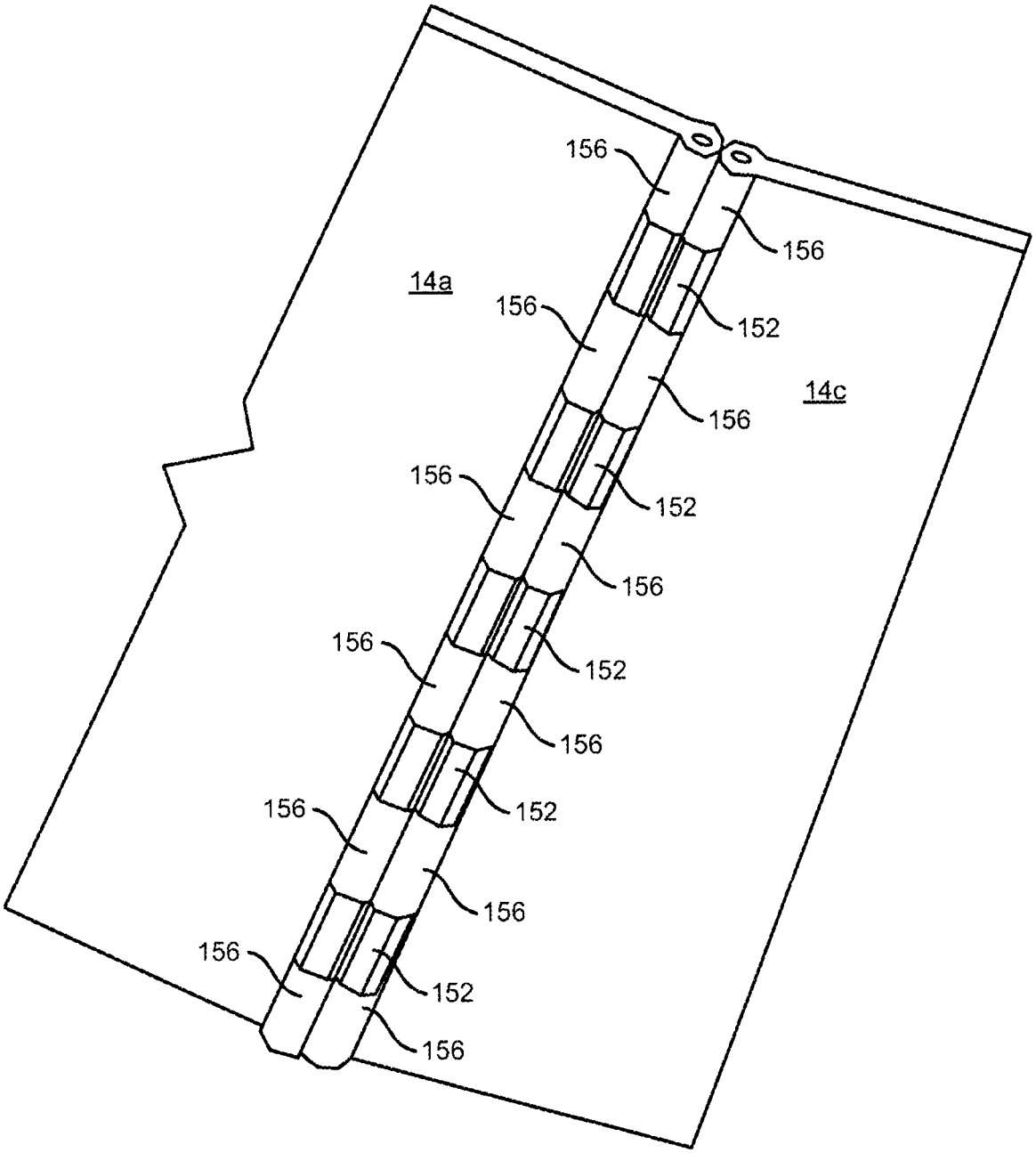

FIGS. 11A, 11B, 11C, and 11D illustrate various embodiments of a hinge 22 embodied as a double hinge. Referring specifically to FIGS. 11A and 11B, in some embodiments a hinge includes two pins 150*a*, 150*b* oriented parallel to one another. The pins 150*a*, 150*b* pass through one or more, preferably two or more, couplers 152 that maintain the pins 150*a*, 150*b* parallel to one another. The pins 150*a*, 150*a* may be rotatable within the couplers 152. Each coupler 154 defines two openings 154*a*, 154*b* receiving the pins 150*a*, 150*b*, respectively. As shown in FIG. 11B, barrels 156 may be formed on, or secured to, panels joined by the hinge 22 (panels 14*a* and 14*c* in the illustrated embodiment, though any pair of panels joined by a hinge 22 according to the embodiments disclosed herein may be joined in a like manner). The barrels 156 are positioned between and/or on either side of the couplers 152 with the pins 150*a*, 150*b* passing through the barrels 154 of the panels 14*a*, 14*c*, respectively, and the openings 154*a*, 154*b*. The illustrated double hinge may have the advantage of functioning as a 90-to-180 degree or a 0-to-90 degree hinge.

Figure 11C:
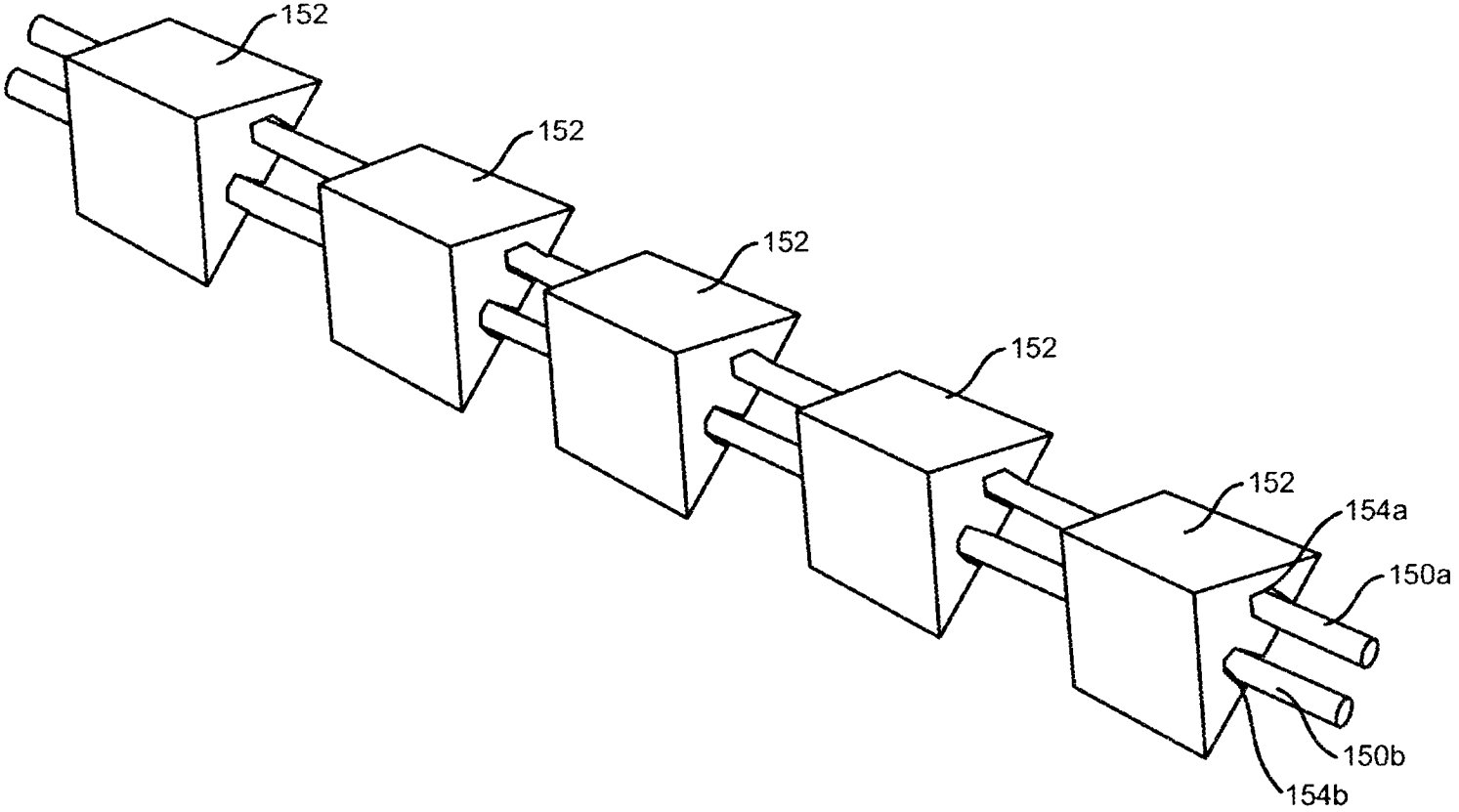
Figure 11D:
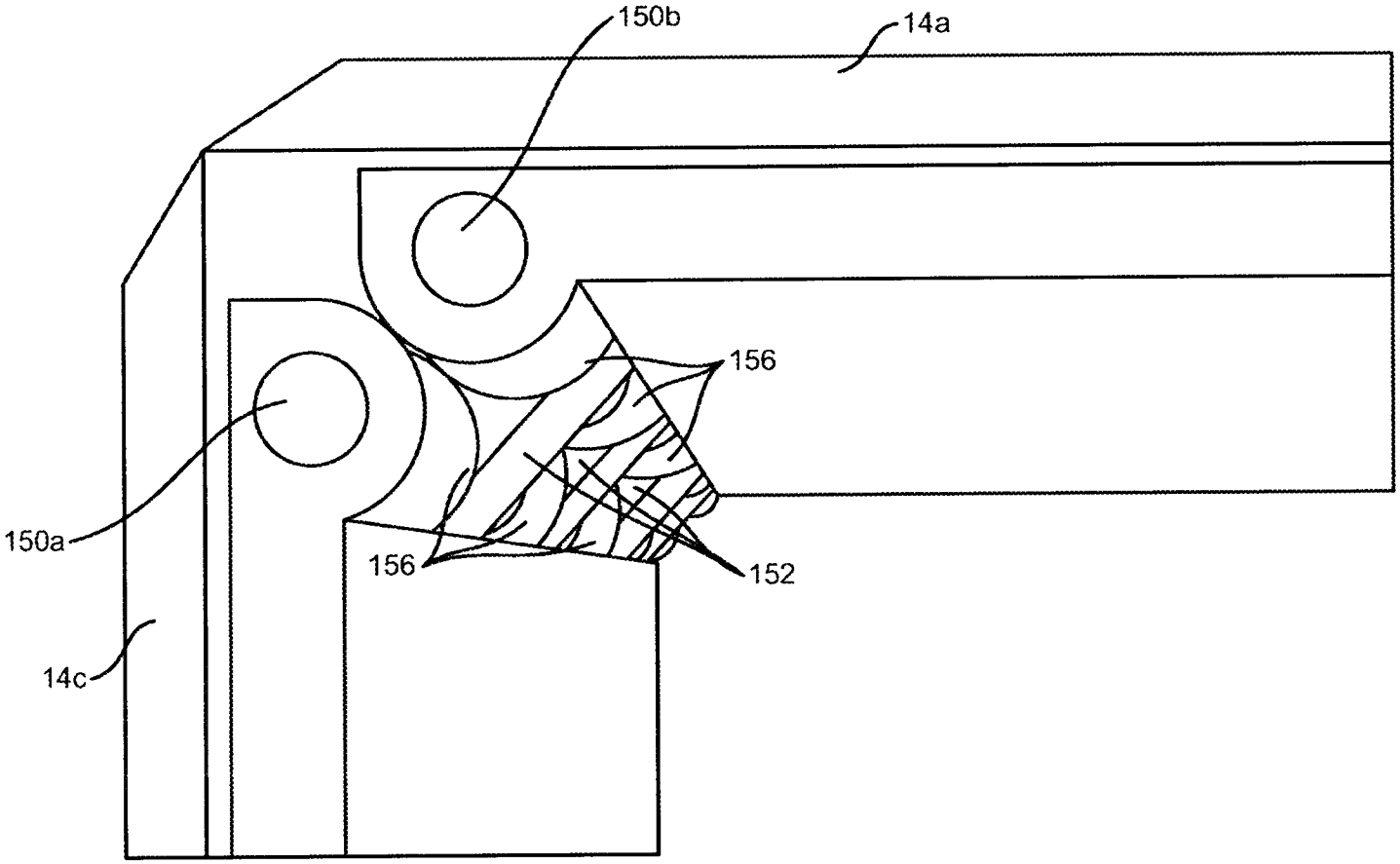

FIGS. 11C and 11D illustrate an alternative embodiment of a hinge 22 embodied as a double hinge. In this embodiment, the couplers 152 are embodied as right triangles and the barrels 156 are formed protruding from an inner surface of the panels joined by the double hinge (panels 14*a*, 14*c* in the illustrated example). As is apparent in FIG. 11D, the triangular couplers 152 interface with the inner surfaces of the panels 14*a*, 14*c*. The couplers 152 may therefore also function as motion limiters and cause the double hinge to function as a 0-to-90 degree hinge.

In some embodiments, the double hinge of FIGS. 11C and 11D is used to implement 0-to-90 degree hinges 22 coupling panels 14*a* and 14*c* and panels 14*b* and 14*c*. The double hinge of FIGS. 11A and 11B may then be used as 90-to-180 degree hinges 22 coupling panels 14*a* and 14*d* and panels 14*b* and 14*c*.

Figure 12A:
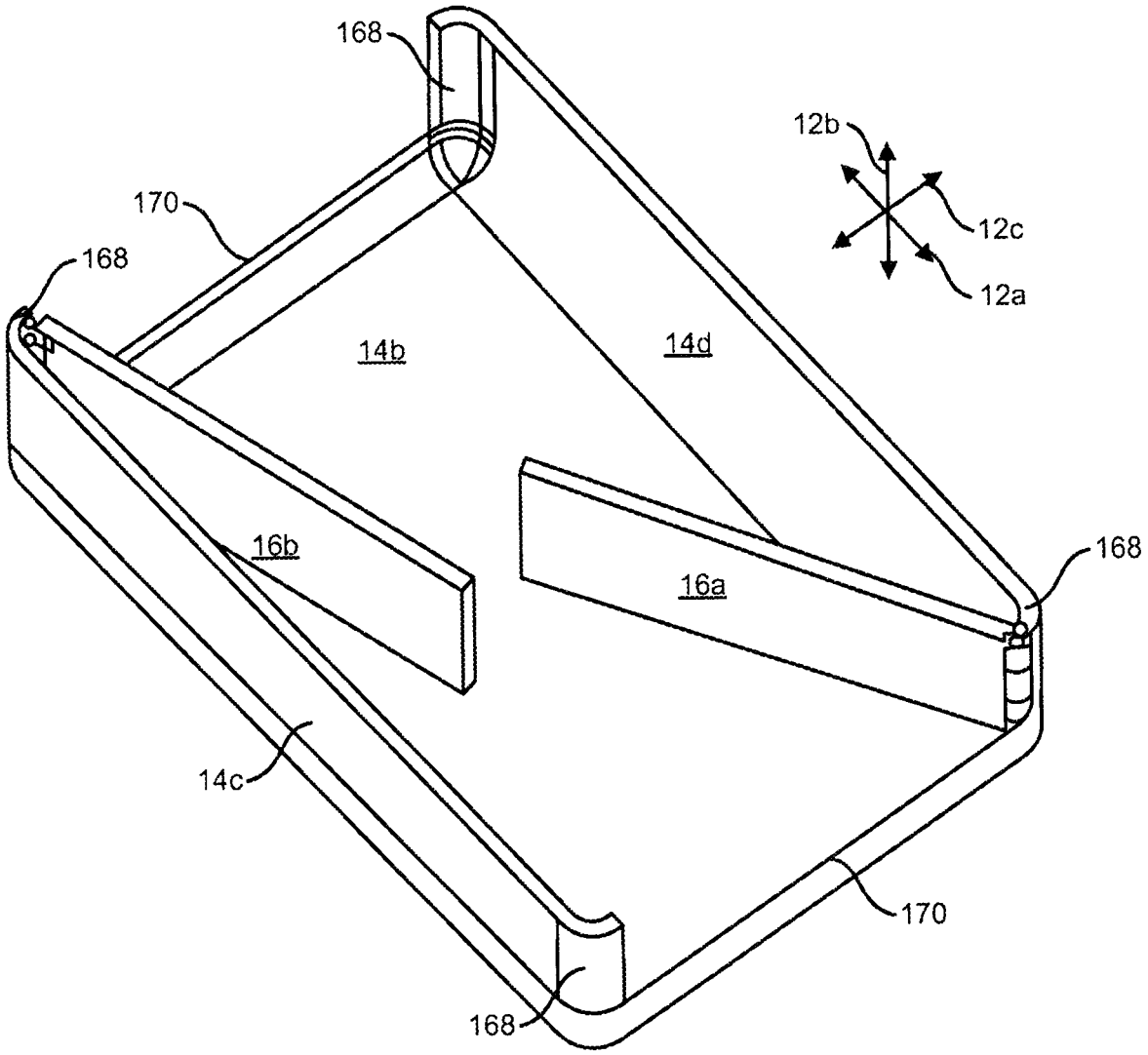
FIGS. 12A to 12C illustrate an approach for implementing endcaps secured to side panels of a yoga block in accordance with an embodiment of the present invention.
Figure 12B:
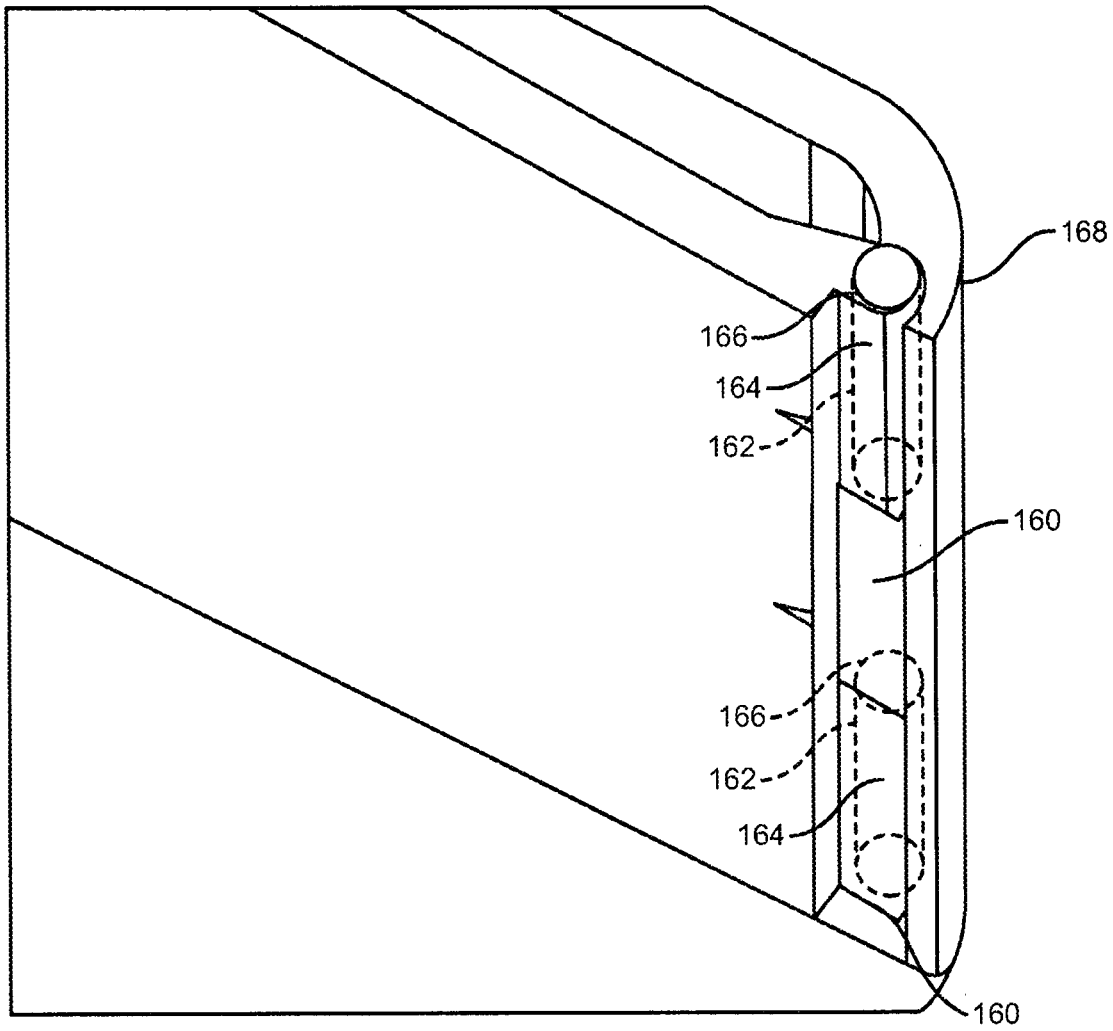
Figure 12C:
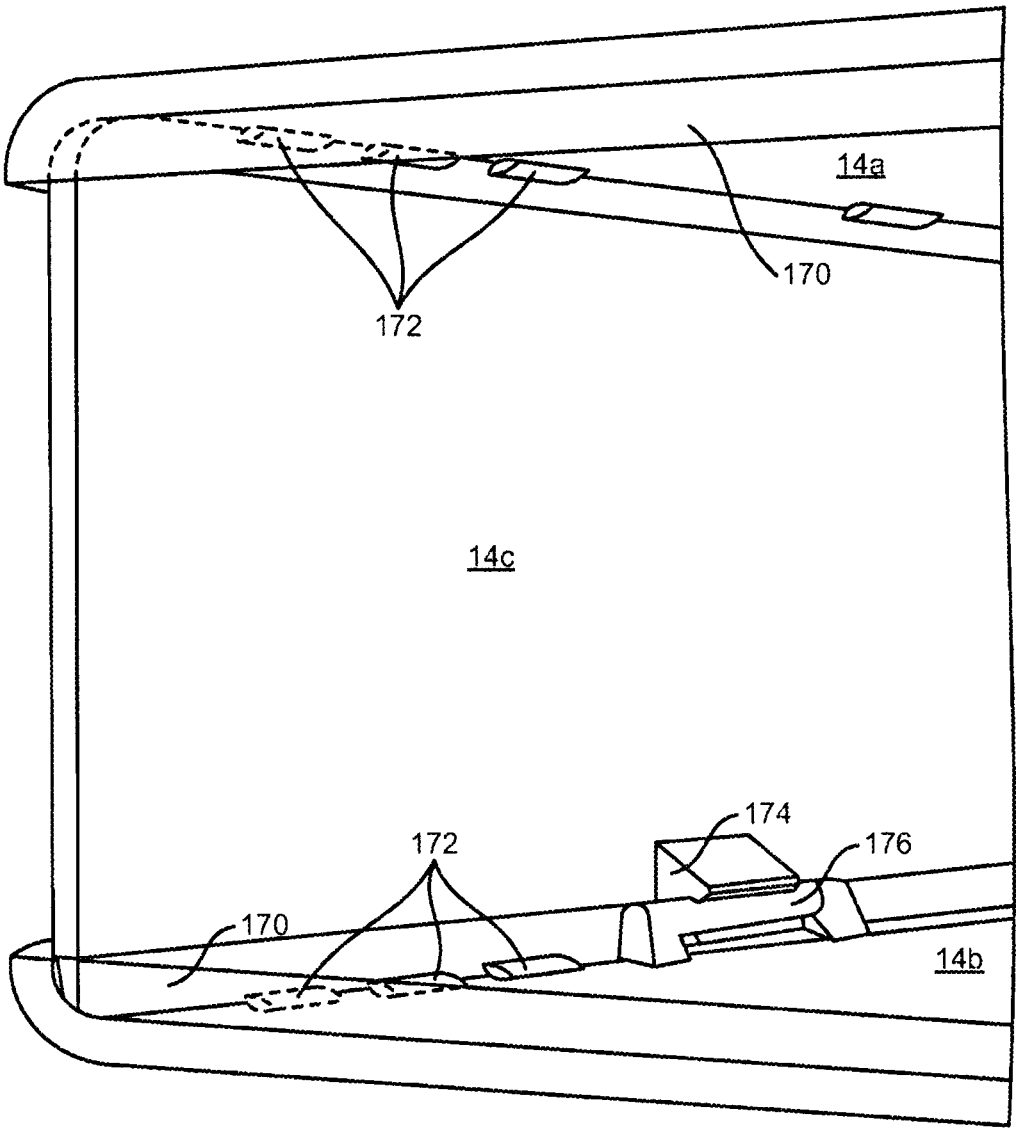

FIGS. 12A, 12B, and 12C illustrate an alternative implementation of a yoga block 10 in which the end cap 16*a* is pivotally attached to the right side panel 14*d* and the end cap 16*b* is pivotally attached to the left side panel 14*c*, with the axis of rotation of the end caps 16*a*, 16*b* being parallel to the vertical direction 12*b*. In the foregoing description, reference is made to the endcap 16*a* and the right side panel 14*d* with the understanding that the endcap 16*b* may secure to the left side panel 14*c* in an identical manner.

For example, referring specifically to FIG. 12B, in the illustrated example, one, two, or more projections 160 secure to an inner surface of the left side panel 14*c*. A cylindrical rod 162 extends upwardly from each projection with its axis of symmetry oriented parallel to the vertical direction 12*b*. The endcap 16*a* includes one, two, or more, projections 164 extending from an edge or inner surface. The projections 164 include cylindrical openings 166 sized to receive the cylindrical rods in a rotatable fashion as shown in FIG. 12B.

The pivotable endcaps 16*a*, 16*b* may be used in any of the embodiments described herein. The pivotable endcaps 16*a*, 16*b* may also be used in combination with one or more other modifications. In particular, the left and right side panels 14*c*, 14*d* may include curved end portions 168 a plane parallel to the longitudinal direction 12*b* and the transverse direction 12*c* (the "longitudinal-transverse" plane). The projections 160 may secure to a concave surface defined by the curved end portion 168 at one end of each panel 14*c*, 14*d*. As is apparent in FIG. 12B, the endcap 16*a*, may be pivoted toward the right side panel 14*d*. The curved end portion 168 results in a hollow or recess defined by the right side panel 14*d* into which the endcap 16*a* may pivot.

Referring to FIG. 12C, in some embodiments, the top panel 14*a* and bottom panel 14*b* include a rim 170 extending inwardly from the around a perimeter of the inner surfaces of the top panel 14*a* and the bottom panel 14*b*. The left side panel 14*a* and the right side panel 14*b* may then seat within recesses defined by the rim 170.

The inner surface of the top panel 14*a*, 14*b* may further include clips 172 distributed along their right and left edges. The left side panel 14*c* and the right side panel 14*d* may engage the clips 172 in order to secure the top panel 14*a*, 14*b* to the left side panel 14*c* and the right side panel 14*d*. Each side panel 14*c*, 14*d* may further include a pivot clamp 174. The pivot clamp 174 of the left side panel 14*c* may be located at its bottom edge, e.g. within 1 cm of its bottom edge. The pivot clamp 174 of the right side panel 14*d* may be located at its top edge, e.g. within 1 cm of its top edge.

The top panel 14*a* and bottom panel 14*d* may each include a pivot 176 mounted thereto and sized to be received within one of the pivot clamps 174 such that the pivot 176 of the top panel 14*a* may be inserted within the pivot clamp 174 of the right side panel 14*d* and the pivot 176 of the bottom panel may be inserted within the pivot clamp 174 of the left side panel 14*c*. In the illustrated embodiment, the pivot clamps 174 and pivots are centered on the panels 14*a*, 14*b*, 14*c*, 14*d* along the longitudinal direction 12*a*. The pivot clamps 174 may permit the pivots 176 to be urged into engagement, i.e. snapped into place and thereafter permit rotation of the pivots 176 within the pivot clamps 174.

In use, the yoga block 10 of FIGS. 12A, 12B, and 12C may be collapsed by pivoting the endcap 16*b* toward the left side panel 14*c* and pivoting the endcap 16*a* toward the right side panel 14*d*. The top panel 14*a* may be unclipped from clips 172 of the left side panel 14*c* and the bottom panel 14*b* may be unclipped from the clips 172 of the right side panel 14*d*. The left side panel 14*c* may then be pivoted about the pivot 176 secured thereto toward the bottom panel 14*b*. The right side panel 14*d* may be pivoted about the pivot 176 secured thereto toward the top panel 14*a*. The yoga block 10 is therefore in a collapsed configuration ready to be stored and transported.

Figure 13A:
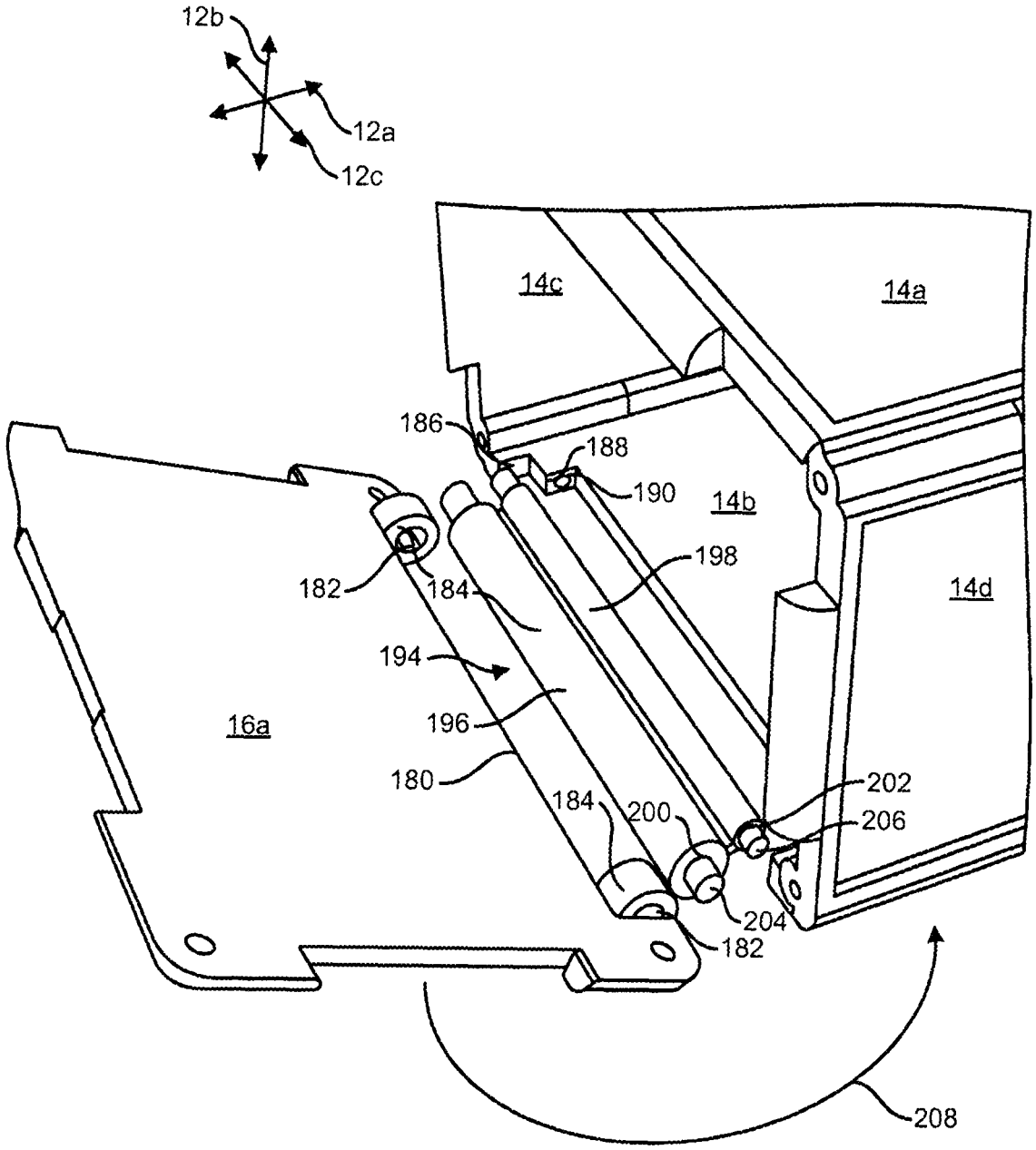
FIGS. 13A and 13B illustrate double hinges for securing endcaps to panels of a yoga block in accordance with an embodiment of the present invention.
Figure 13B:
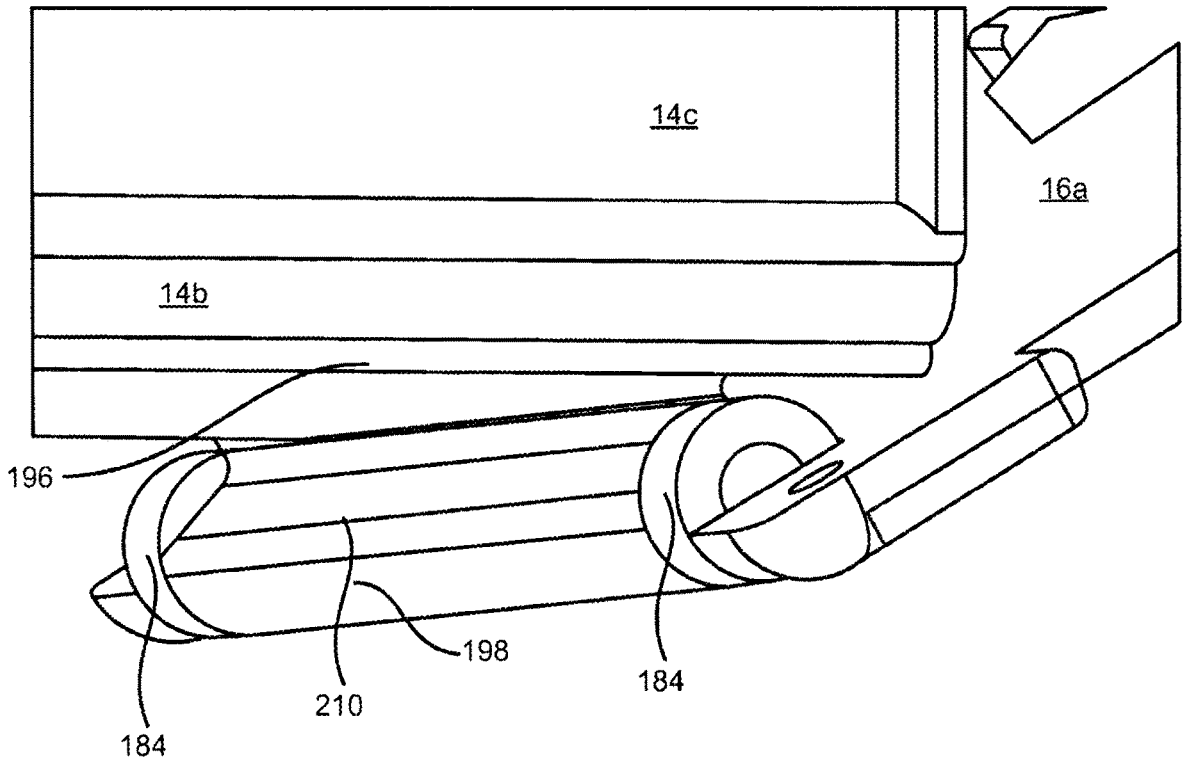

Referring to FIGS. 13A and 13B, in some embodiments, the endcaps 16*a*, 16*b* may secure to either of the panels 14*a*, 14*b* (endcap 16*a* and bottom panel 14*b* being shown in FIG. 13A) using the illustrated double hinge. Note that the function of the double hinge may be performed by a flexible member such as a strip of flexible plastic or metal secured to a panel 14*a*, 14*b* and an endcap 16*a*, 16*b*. Securement to the forward end of the quadrilateral tube is shown with the understanding that securement to the rearward end may be performed in the same manner. In the illustrated embodiment, a recess 180 is defined extending inwardly from an edge (bottom edge in the illustrated embodiment) of the endcap 16*a* and openings 182 are defined on either side of the recess, such as in cylindrical portions 184 secured on either side of the recess 180.

The bottom panel 14*b* may further include a recess 186 extending inwardly from its forward edge and a shorter (along the transverse direction 12*c*) recess 188 extending inwardly from the recess 186. Openings 190 may be defined on either side of the recess 188 (only one visible in FIG. 13).

A coupler 194 for the double hinge may be embodied as a pair of cylinders 196, 198 fastened to one another, such as by co-molding. The cylinders 196, 198 define openings 200, 202, respectively, having axes of symmetry oriented parallel to the transverse direction 12*c*. Pins 204, 206 may be inserted within these openings 200, 202 such that portions of the pins 204, 206 protrude from either side of the cylinders 196, 198. In some embodiments, the pins 204, 206 may be spring loaded to facilitate installation. In particular, the pins 204, 206 may be pressed inward into the openings 200, 202 in order to be positioned between the openings 182 and the openings 190, respectively, after which the pins 204, 206 are allowed to expand into the openings 182, 190. The recess 186 may be sized such that the cylindrical portions 184 are positioned within the recess 186 when the endcap 16*a* is in a closed position against the end of the quadrilateral tube.

Following installation, the endcap 16*a* may then be pivoted about the double hinge with the offset between the pins 204, 206 enabling the endcap 16*a* to be folded back (see curve 208) such that the endcap 16*a* lays flat against the outer surface of the bottom panel 14*b* when the quadrilateral tube is collapsed. In the case where pads 48 are used on the panels 14*a*, 14*b*, 14*c*, 14*d* and the endcaps 16*a*, 16*b*, the outward facing surface of the pad 48 secured to the outer surface of endcap 16*a*, 16*b* will lay against the outward facing surface of the pad 48 secured to the outer surface of the bottom panel 14*b*. In some embodiments, the cylinder 198 may include a flattened region 210 that is oriented downwardly and substantially (within 5 degrees of) parallel to the bottom surface 14*b* when the endcap 16*a* is closed against the forward end of the quadrilateral tube. In some embodiments, the illustrated double hinge approach may be used to secure the endcap 16*b* to the top panel 14*a* such that the endcap 16*a* may be pivoted over the outer surface of the top panel 14*a* when the quadrilateral tube is collapsed.

FIGS. 14A to 14D illustrate another embodiment of a double hinge and other features that may be incorporated into any of the foregoing embodiments. The operation of the double hinge is described below with respect to the bottom panel 14*b* and the endcap 16*a* with the understanding that the endcaps 16*a*, 16*b* could secure to any of the panels 14*a*, 14*b*, 14*c*, 14*d* using the illustrated double hinge. Likewise, each endcap 16*a*, 16*b* may be secured to different panel 14*a*,14*b*, 14*c*, 14*d* than the other endcap 16*a*, 16*b*.

The endcap 16*a* may define two or more slots 220 extending inwardly from its bottom edge. The bottom panel 14*a* may likewise define two or more slots 222 extending inwardly from its forward edge and which are aligned with the slots 220 along the transverse direction 12*c*. Two or more couplers 224 each insert within one slot 220 and one slot 222. As can be seen in FIG. 14C, the couplers 224 may define a surface 226 that conforms to the raised ridge and edge of the bottom panel 14*b* and the bottom edge of the endcap 16*a*. The couplers 224 may further define a surface 228 that is recessed relative to the surface 226 and conforms to the lower surface of the recess 42. In this manner, a pad 48 (see FIG. 5C) may still be placed in the recess 42. The pad 48 in such embodiments that is placed in the bottom panel 14*b* may include slots positioned over slots 222 to facilitate movement of the couplers 224

As shown in FIG. 14B, the couplers 224 may be rotatably secured to the bottom panel 14*b* and the end cap 16*a*. For example, slot 230 in the bottom panel 14*b* perpendicular to the slot 220 (substantially parallel to the transverse direction 12*c*) may facilitate insertion of a pin 234 through the coupler 224 and through openings provided in the bottom panel 14*b*. Likewise, a pin 232 may be positioned in the endcap 16*a* and pass through the coupler 224.

In the embodiment of FIGS. 14A to 14C, the pair of magnets 26 and opening 24 closest to the top edge of the endcap 16*a* are retained whereas the pair of magnets 26 and openings 24 closer to the lower edge are omitted. However, four magnets 26 may be used in the embodiments of FIGS. 14A to 14C as for other embodiments disclosed herein. In the embodiment of FIGS. 14A to 14C and other embodiments disclosed herein, a single magnet 26 may be used. For example, one or more magnetic elements (magnet or ferromagnetic material) in the endcap 16*a* may engage a corresponding magnetic element secured anywhere on a forward end of the quadrilateral tube as described above with respect to FIG. 2. The embodiments of FIGS. 14A to 14C may replace magnetic attachment with any of the locking mechanisms disclosed herein (rotating lock of FIGS. 6A to 6D, sliding lock of FIGS. 7A to 7C) or any other closure mechanism, such as a friction lock.

Referring specifically to FIGS. 14C and 14D, in some embodiments, magnetic elements 238 may be mounted to the bottom panel 14*b*, such as in the recess 42 beneath the pad 48. The magnetic elements 238 may be magnets or ferromagnetic material positioned such that when the end cap 16*a* is folded over the bottom panel in a stowed position as shown in FIG. 14D, the magnets 26, or other magnetic element, are positioned over the magnetic elements 238 and magnetic attraction between the magnets 26, or other magnetic element, and the magnetic elements 238 provides a degree of retention force (e.g., at least equal to the weight of the endcap 16*a*, at least 4 Newtons, or other degree of retention force). The centers of the magnets 26, or other magnetic element, and magnetic elements 238 may be alignable (e.g., within the range of motion permitted by the double hinge) to within 2 mm of one another along the longitudinal direction 12*a* and transverse direction 12*c* when the endcap 16*a* is positioned over the bottom panel 14*b*. Corresponding magnetic elements 238 mounted to the bottom panel 14*b* may also be positioned to engage magnets 26, or other magnetic element, in the endcap 16*b*.

The endcaps 16*a*, 16*b* in the embodiment of FIGS. 14A to 14D and in any of the foregoing embodiments, particularly those using magnetic attachment, may include one or more finger grooves 236. The finger grooves 236 may be recesses formed on an inward facing surface of the endcap 16*a*, 16*b* and extending to the upper edge of the endcap 16*a*, 16*b* such that a user may insert a finger tip into the finger groove 236 in order to pull end endcap 16*a*, 16*b* away from an end of the quadrilateral tube formed by the panels 14*a*, 14*b*, 14*c*, 14*d*. The finger grooves 236 may therefore be used in place of or in addition to the strap 50.

The embodiment of FIGS. 14A to 14D may include two or more protrusions 20 extending from the forward and rearward ends of the panels 14*a*, 14*b*, 14*c*, 14*d* that engage corresponding recesses 18 defined by the endcaps 16*a*,16*b* as for other embodiments disclosure herein. However, in some embodiments, a single protrusion 20 and recess 18 are used on only one of the panels 14*a*, 14*b*, 14*c*, 14*d*, such as the panel opposite the panel to which the double hinge is secured, which is the top panel 14*a* in the illustrated embodiments. As for other embodiments, the one or more protrusions 20 may be defined on the endcaps 16*a*, 16*b* and insert within one or more recesses 18 defined by one or more of the panels 14*a*,14*b*, 14*c*, 14*d*.

While preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge;

wherein the front cap is secured at a first edge to the first panel by the double hinge and includes a locking mechanism closer to a second edge than to the first edge, the second edge being opposite the first edge;

wherein the locking mechanism is one or more first magnetic elements and one or more second magnetic elements are secured to the first panel such that the one or more first magnetic elements engage the one or more second magnetic elements when the front cap is positioned over the outer surface of the first panel;

wherein the front cap is secured at a first edge to the first panel by the double hinge and includes a second edge opposite the first edge; and wherein one of:

the second edge defines a recess sized to receive a protrusion from a second panel that is one of the top panel, the bottom panel, the right panel, and the left panel that is not the first panel; and the second edge defines a protrusion sized to insert within a recess in the second panel.

2. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge; and further comprising at least two protrusions and at least two recesses, the at least two protrusions sized to insert within the at least two recesses wherein one of:

the at least two protrusions are formed in forward edges of at least two of the top panel, bottom panel, left panel, and right panel and the at least two recesses are defined by the front cap; and the at least two recesses are formed in forward edges of at least two of the top panel, bottom panel, left panel, and right panel and the at least two protrusions are defined by the front cap;

wherein the front cap has one or more magnets secured thereto and each positioned to magnetically engage with one or more of the top-left hinge, the bottom-left hinge, the top-right hinge, and the bottom-right hinge.

3. The collapsible yoga block of claim 2, wherein each of the front cap and the rear cap includes a lock selectively engaging one of the top panel, bottom panel, left panel, and right panel.

4. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge;

further comprising a protrusion and a recess wherein one of:

the protrusion extends outwardly from a forward edge of the top panel and the recess extends inwardly from a top edge of the front cap such that the protrusion is positioned in the recess when the front cap abuts the forward edge of the top panel;

the protrusion extends outwardly from the top edge of the front cap and the recess extends inwardly from the forward edge of the top panel such that the protrusion is positioned in the recess when the front cap abuts the forward edge of the top panel; and wherein the front cap has one or more first magnetic elements secured thereto and each positioned to magnetically engage with one or more second magnetic elements secured to a forward edge of the quadrilateral tube and wherein the rear cap has one or more third magnetic elements secured thereto and each positioned to magnetically engage with one or more fourth magnetic elements secured to a rearward edge of the quadrilateral tube.

5. The collapsible yoga block of claim 4, wherein the front cap defines one or more indentations on an inward facing surface thereof and extending to an edge of the front cap.

6. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge;

further comprising a protrusion and a recess wherein one of:

the protrusion extends outwardly from a forward edge of the top panel and the recess extends inwardly from a top edge of the front cap such that the protrusion is positioned in the recess when the front cap abuts the forward edge of the top panel;

the protrusion extends outwardly from the top edge of the front cap and the recess extends inwardly from the forward edge of the top panel such that the protrusion is positioned in the recess when the front cap abuts the forward edge of the top panel; and wherein:

the front cap defines four inner openings, four magnets being mounted to an outer surface of the front cap over the four inner openings, an inner surface of the rear cap positioned opposite the outer surface facing the forward edges of the top panel, bottom panel, left panel, and right panel when the front cap is positioned over the forward end of the quadrilateral tube; and the top-left hinge, bottom-left hinge, top-right hinge, and bottom-right hinge each includes a pin protruding outwardly therefrom and magnetically engaging one of the four magnets through one of the four inner openings when the front cap is positioned over the forward end of the quadrilateral tube.

7. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge; and wherein each of the top panel, bottom panel, left panel, right panel, front panel, and rear panel define a recessed portion having a pad seated within the recessed portion.

8. The collapsible yoga block of claim 7, wherein each of the top panel, bottom panel, left panel, right panel, front panel, and rear panel include a ridge extending around a perimeter thereof, the recessed portion being defined by the ridge.

9. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge; and wherein the top-left hinge and the bottom-right hinge each include barrel portions each having a cylindrical portion and a flattened portion positioned such that upon collapsing of the quadrilateral tube, the flattened portion of the barrel portions of the top-left hinge interfaces with the bottom panel and the flattened portion of the barrel portions of the bottom-right hinge interfaces with the bottom panel.

10. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge; and further comprising a top groove formed on an inner surface of the top panel facing inwardly into the quadrilateral tube and a bottom groove formed on an inner surface of the bottom panel facing inwardly into the quadrilateral tube, the top groove extending at least 80 percent of a width of the top panel between the forward end and the rearward end and the bottom groove extending at least 80 percent of a width of the bottom panel between the forward end and the rearward end of the quadrilateral tube.

11. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube such that the front cap resists rotation of the top panel, bottom panel, left panel, and right panel relative to one another; and a rear cap removably positioned over a rearward end of the quadrilateral tube such that the rear cap resists rotation of the top panel, bottom panel, left panel, and right panel relative to one another;

wherein the front cap is secured to a first panel that is one of the top panel, bottom panel, left panel, and right panel by a double hinge such that the front cap can be both positioned against front edges of the top panel, bottom panel, left panel, and right panel and rotated to be positioned over an outer surface of the first panel;

wherein the double hinge includes at least one coupler attached to the first panel by a first hinge and attached to the front cap by a second hinge offset from the first hinge; and further comprising:

a top groove formed on an inner surface of the top panel facing inwardly into the quadrilateral tube and a bottom groove formed on an inner surface of the bottom panel facing inwardly into the quadrilateral tube, the top groove and the bottom groove extending from the forward end to the rearward end of the quadrilateral tube; and a plate having a top edge of the plate engaged with the top groove and a bottom edge of the plate engaged with the bottom groove, wherein the plate is made of a first material at least 10 times as dense as a second material forming the top panel, bottom panel, left panel, and right panel.

12. A method comprising:

providing a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

providing a front cap removably positioned over a forward end of the quadrilateral tube such that the front cap resists rotation of the top panel, bottom panel, left panel, and right panel relative to one another;

providing a rear cap removably positioned over a rearward end of the quadrilateral tube such that the rear cap resists rotation of the top panel, bottom panel, left panel, and right panel relative to one another;

moving the front cap and the rear cap away from the quadrilateral tube;

collapsing the top panel toward the bottom panel; and stowing the front cap and the rear cap against an outer surface of one of the top panel, bottom panel, left panel, and right panel;

wherein moving the front cap and the rear cap away from the quadrilateral tube comprises disengaging one or more first magnets in the front cap from the quadrilateral tube and disengaging one or more second magnets in the rear cap from the quadrilateral tube.

13. The method of claim 12, wherein moving the front cap and the rear cap away from the quadrilateral tube comprises pivoting the front cap about a first double hinge coupling the front cap to the quadrilateral tube and pivoting the rear cap about a second double hinge coupling the rear cap to the quadrilateral tube.

14. A collapsible yoga block comprising:

a quadrilateral tube including:

a top panel;

a bottom panel;

a left panel secured to a left side of the top panel by a top-left hinge and secured to a left side of the bottom panel by a bottom-left hinge; and a right panel secured to a right side of the top panel by a top-right hinge and secured to a right side of the bottom panel by a bottom-right hinge;

a front cap removably positioned over a forward end of the quadrilateral tube;

a rear cap removably positioned over a rearward end of the quadrilateral tube; and an insert removably positioned within the quadrilateral tube and including one or more rigid elements at a non-perpendicular angle relative to the top panel and the bottom panel and extending between the top-left hinge and the bottom-right hinge.

* * * * *